US009010025B2

(12) United States Patent
Osann, Jr.

(10) Patent No.: US 9,010,025 B2
(45) **Date of Patent: *Apr. 21, 2015**

(54) HIGH TRAFFIC FLOW ROBOTIC PORTAL FOR SECURE ACCESS

(71) Applicant: Robert Osann, Jr., Port Angeles, WA (US)

(72) Inventor: Robert Osann, Jr., Port Angeles, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/485,705

(22) Filed: Sep. 13, 2014

(65) Prior Publication Data

US 2014/0373761 A1 Dec. 25, 2014

Related U.S. Application Data

(63) Continuation of application No. 13/952,409, filed on Jul. 26, 2013, now Pat. No. 8,832,997, which is a continuation-in-part of application No. 12/502,997, filed on Jul. 14, 2009, now Pat. No. 8,499,494.

(60) Provisional application No. 61/135,322, filed on Jul. 18, 2008, provisional application No. 61/763,943, filed on Feb. 12, 2013, provisional application No. 61/775,522, filed on Mar. 9, 2013.

(51) Int. Cl.

| | |
|---|---|
| ***E05D 15/58*** | (2006.01) |
| ***E05G 5/02*** | (2006.01) |
| ***E05F 17/00*** | (2006.01) |

(Continued)

(52) U.S. Cl.

CPC ..... *E05G 5/02* (2013.01); *E05F 17/002* (2013.01); *E05F 15/00* (2013.01); *E05G 5/003* (2013.01); *E05D 15/58* (2013.01); *E05Y 2400/82* (2013.01); *E05Y 2900/132* (2013.01); *E05F 2017/008* (2013.01); *E06B 9/04* (2013.01);

(Continued)

(58) Field of Classification Search

CPC ..... E06B 3/50; E06B 3/5009; E06B 3/5018; E06B 3/90; E06B 3/903; E06B 3/906

USPC ..... 49/10–115, 248, 254, 257, 258, 260, 49/73.1, 142, 143, 154, 155, 156, 158, 49/163, 261, 138; 109/67–71; 70/DIG. 65

See application file for complete search history.

(56) References Cited

U.S. PATENT DOCUMENTS

| | | | |
|---|---|---|---|
| 4,122,783 | A | 10/1978 | Pretini |
| 4,586,441 | A | 5/1986 | Zekich |

(Continued)

FOREIGN PATENT DOCUMENTS

| | | |
|---|---|---|
| FR | 2610361 | 8/1988 |
| JP | 63-027677 U | 2/1988 |

(Continued)

*Primary Examiner* — Katherine Mitchell
*Assistant Examiner* — Catherine A Kelly
(74) *Attorney, Agent, or Firm* — Cherskov Flaynik & Gurda, LLC

(57) ABSTRACT

Electro-mechanical and electronically controlled access devices are described for controlling access to a building, premises or area in a secure manner such that a subject who is deemed ineligible for access will be barred entry and may be optionally retained. The devices can contain multiple rotatable door panels, which can be positioned behind one another. The door panels can be controlled by mechanized arms or other control devices in order to control the passage through the device. The direction of flow through a device according to these embodiments is electronically controlled and may be changed at any point in time. At any instant in time, the flow through the device is unidirectional. Multiple devices can be stacked together to form clusters, which can be controlled according to traffic, time of day, or other factors.

20 Claims, 28 Drawing Sheets

(51) Int. Cl.
*E05G 5/00* (2006.01)
*E06B 9/04* (2006.01)
*E05F 15/00* (2006.01)

(52) U.S. Cl.
CPC ..... *E05F 15/40* (2015.01); *E05F 15/608* (2015.01); *E05F 15/73* (2015.01)

(56) References Cited

U.S. PATENT DOCUMENTS 4,738,052 A 4/1988 Yoshida
4,741,275 A 5/1988 Lewiner et al.
5,195,448 A 3/1993 Sims
5,311,166 A 5/1994 Frye
5,542,211 A 8/1996 Colombo
5,625,176 A 4/1997 Davis et al.
5,634,295 A 6/1997 Bunzl
5,694,867 A 12/1997 Diaz-Lopez
5,711,111 A 1/1998 Nyffenegger et al.
5,845,692 A 12/1998 Kellem et al.
6,176,044 B1 1/2001 Nixon
6,298,603 B1 10/2001 Diaz
6,308,644 B1 10/2001 Diaz
6,472,984 B1 10/2002 Risi
6,484,650 B1 11/2002 Stomski
6,543,185 B1 4/2003 Borelli
6,615,894 B1 9/2003 McKeon
6,742,301 B1 6/2004 Schwarz
6,931,987 B2 8/2005 Pax et al.
2004/0262383 A1 12/2004 Zielinski
2006/0086894 A1 4/2006 Shepherd
2006/0218863 A1 10/2006 Eshel et al.
2007/0047837 A1 3/2007 Schwab et al.
2008/0244978 A1 10/2008 Soyugenc

FOREIGN PATENT DOCUMENTS

JP 7026836 A 1/1995
JP 2003-214045 7/2003
JP 2004-183300 A 7/2004

Gap filler by telescoping extension

Gap filler by sliding filler panel

Imaging emitters and sensors mounted in moving door panels and side panels

Sliding roof panels replace moving arms to drive moving door panels

Sliding roof panels replace moving arms to drive moving door panels.
Panels slide in an out of optional receptacles at each end

HIGH TRAFFIC FLOW ROBOTIC PORTAL FOR SECURE ACCESS

CLAIM OF PRIORITY

This patent application claims priority as a continuation of U.S. patent application Ser. No. 13/952,409 filed on Jul. 26, 2013, currently pending, which in turn claimed priority as continuation in part of U.S. patent application Ser. No. 12/502,997 filed on Jul. 14, 2009 which issued as U.S. Pat. No. 8,499,494 on Aug. 6, 2013 and also as a Non-provisional application of U.S. Provisional Application Ser. No. 61/763,943 filed on Feb. 12, 2013, and also as a Non-provisional application of U.S. Provisional Application Ser. No. 61/775,522 filed on Mar. 9, 2013. U.S. patent application Ser. No. 12/502,997, in turn, claimed the priority benefit as a Non-provisional application of U.S. Provisional Application Ser. No. 61/135,322 filed on Jul. 18, 2008, the contents of which are hereby incorporated by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The current invention relates generally to secure entry points and access control devices that control the passage of pedestrians or vehicles in such a way as to provide a more secure access path to a building, premises, or secured area.

BACKGROUND

A wide variety of security access control devices exist today which attempt to control access to secure areas. Security checkpoints at airports include metal detection and various forms of x-ray and scanning capability, however if a person carrying a weapon was determined to pass through such a security checkpoint while knowing they would be instantly detected, they could do so, and until they were apprehended they could use their weapon within the airport. Metal detectors at the entrance to banks will warn if someone carries a gun into a bank, however it will not stop them from doing so.

Many security systems combine identification mechanisms such as cards, fingerprints, or optical scan in order to identify an individual and allow them access. Unfortunately, the perpetrator of the crime is sometimes one normally allowed access to a facility or area, and use of an identification card will not hinder them. In the case of large gatherings such as lecture halls at universities, schools in general, sporting events, and large business facilities, if a person with suicidal tendencies is determined to wreak havoc and destruction upon a large number of people, today's security access devices will not prevent them from entering if they are carrying a weapon and intend to use it.

Therefore, a new security access control device is needed that will not only detect a person carrying a weapon and attempting to pass through an access point, but will absolutely prevent that person from passing if a decision is made to prevent them—that decision often being made automatically.

Also, and given the fact that many of the institutions mentioned above normally allow unhindered access into areas where large gatherings occur, it is important that any new security access device allow high traffic flow at peak times while still being capable of stopping a person carrying a weapon.

A form of access mechanism still popular today is that of a revolving door. It provides continuous flow in both directions, and in spite of the fact that entry into a revolving door can be a little intimidating for some people, revolving doors are deemed to be safe, people understand how to use them, and they continue to be designed into new buildings including hotels, banks and airports. As a side benefit, a revolving door minimizes energy loss due to the manner in which air passes through the door.

There are negatives relative to using a conventional revolving door in a security application, and especially in applications where the amount of traffic is substantial. Conventional revolving doors provide a fixed amount of traffic flow, and the level of flow is always equal in both directions. Thus at a time of day when most people will be exiting a facility, a revolving door will have one half of its capacity unutilized, and therefore a conventional revolving door is space-inefficient. In other words, given an entry passageway to a facility or area of a certain width, a conventional revolving door would be wasting half of that width at times of peak flow in primarily one direction.

If a person in a revolving door was detected to be suspect of carrying a weapon, the revolving door would be stopped and possibly reversed, however if another person was simultaneously exiting in the opposite direction within the same revolving door, they would be stuck in the door, or forced to back up.

Full height turnstiles with multiple crossbars can be useful but have similar problems. Only half the width of a conventional turnstile unit is used for passage and the other half is not usable because of the style of construction of these units. Also, because a conventional turnstile is stationary, placing two of them in series in order to stop a detected perpetrator between them creates the requirement for both of them to be closed at the same time, and also that they both should never be open simultaneously. As a result, a person cannot enter such a turnstile complex while the person ahead of them is simultaneously leaving. Thus the use of a conventional turnstile tends to impede the flow of traffic and is space-inefficient in a manner similar to a revolving door.

What is needed is a security access control device that is space efficient, extremely high throughput, and offers great flexibility in directional control, while at the same time will absolutely prevent a person carrying a weapon from entering a secured area. Applicant has identified these, as well as other shortcomings and needs in the current state of the art in coming to conceive the subject matter described and claimed throughout in this patent application.

SUMMARY OF THE INVENTION

The embodiments of the invention described herein are electro-mechanical and electronically controlled access devices for controlling access to a building, premises or area in a secure manner such that a person who is deemed ineligible for access will be barred entry and may be optionally retained. One or more access control devices according to this invention would be deployed such that only way to enter a secured area would be through an access control device. A subject wishing to enter a secured area protected by such devices would find the spaces adjacent to and above the access control device sealed allowing the only route of passage to be through an access control device. The direction of flow through a device according to these embodiments is electronically controlled and may be changed at any point in time. At any instant in time, the flow through the device is unidirectional. The terms "access control device" and "security portal" and "portal" are herein used synonymously.

One object of the various embodiments of this invention is to provide a security access control device that is space (width) efficient while offering extremely high throughput, such that subjects attempting to walk through the security access control device may do so while walking continuously through the security access control device. The security access control device should be suitable for operation at the entrance to different forms of facilities where people may gather, including the following:

Airport main entrances
Train and Bus stations
Hotels
Banks
Churches, Synagogues, and Mosques
Marketplaces and Malls
Stadiums and conference halls
Government and office buildings
Factories
High schools, colleges, and universities One object of the various embodiments is that multiple access control devices such as those described herein may be stacked side by side to allow further increased traffic flow, and that the width is as small as possible to allow a large number of such access devices to be stacked side-by-side thereby further increasing traffic flow when the space available for such access devices is limited. When multiple access control devices are used, the number of devices allowing flow in one direction relative to the opposite direction may be varied according to time of day and according to demand. For instance if used at the entrance to a building at a time when individuals are expected to be mostly entering the secure area, the majority of the access controlling devices would be controlled to allow flow in the direction consistent with entering. Control of which portals within a stack or gang are in "enter" mode and which are in "exit" mode may be optionally performed automatically by a central control system that controls multiple portals. Such a central control system may make decisions on the directional flow of individual portals within a gang based on information describing the aggregate directional flow of a crowd of subjects as determined by sensor(s) that observe the areas on the exit and entrance sides of a stack or gang of multiple portals. Such sensor(s) may use visual, sonic, IR, or RF imaging to observe aggregate traffic flow to determine the overall magnitude of flow and the aggregate magnitudes of flow in each of entrance and exit directions. As part of this control, a particular portal may need to change direction from time to time. When a portal is about to change direction, a message can be displayed on that particular portal that in a specific time period, it will change direction and cease to allow passage for those currently in line should a queue exist. Such a message can also count down the tine remaining so that individuals who will need to move to a different portal are properly and fairly notified in plenty of time to make the move. Upon an emergency such as a fire or earthquake, all devices could be set to a mode consistent with exiting the secured premises. Alternately, the device is capable of being electronically controlled to be placed in a mode where all doors contained therein are fully open and individuals have unimpeded capability to exit a premises in the emergency.

In various embodiments, a variety of sensor technologies may be incorporated into the device, such that as an individual is entering and is subsequently contained within the doors of the device, the individual and their belongings are scrutinized to determine if a weapon is present. Such technologies may include but are not limited to metal detectors, chemical, explosive, biological, and radiological sensors, and different scanning technologies including x-ray imaging and penetrating RF imaging such as (UWB) radar imaging or millimeter wave imaging. Such sensors and associated sensor-related components may be incorporated into any components of the structure comprising the linear revolving door mechanism, including the side walls, floor, ceiling, and any surfaces of the moving door panels. Video imaging may also be included such that a subject's face may be observed as they walk through the access control device. Observing and analyzing the expressions on a subject's face have been shown to offer clues as to a subject's state of mind—especially when they are contemplating a violent act and/or self-destruction.

Another object of the various embodiments is that each door panel should move automatically without requiring or allowing any contact with subjects passing through the access control device, and by sensing the proximity and movement of subjects passing through, will automatically adjust the rate of movement of the different door panels within the access control device to match the speed of movement of a subject, thus maximizing the throughput rate of the access control device by adapting to the rate of movement of each subject passing through. In order to do this, door panels are driven by electromechanical means controlled by a computer/processor. In addition, proximity sensors in the door panels and/or the side panels sense the location of individuals approaching the access control device and passing through it, and the rate of movement and position of the door panels is controlled such that panels never touch individuals passing through. The movement of the door panels can be controlled to track the pace of the subject walking through and match their pace to allow maximum throughput, as long as there is still enough time while both door panels are "closed" to form a detection chamber and take a reading of included threat sensors. Various types of proximity/position sensors are known in the art and may be used including sound, IR, and RF based sensors. Additionally, emitters and receivers for position and/or proximity sensing may be placed in the top cover and/or the floor of the portal.

Another object of the various embodiments is that weapon passing from one perpetrator to another through the access control device is not possible. To fulfill this objective, any gaps that exist between a door panel and a side panel at any point during the motion of that door panel may be optionally filled by additional sliding panels which move adjacent to a side panel in the vicinity of a door panel and are electromechanically controlled such that any gap that may emerge is filled, these additional sliding "panels" being controlled such that their motion does not interfere with the movement of any door panel. Alternately, each of the moving door panels may contain a telescopic extension that extends to fill the gap between that panel and a side panel of the access control device. To further prevent passing of weapons through the portal, and also to enable temporary sealing of a "detection chamber" that is briefly formed when the moving door panels of a portal are parallel, additional gap filling and sealing embodiments are included between the moving door panels and the top cover of the portal to temporarily block air movement in and out of the "detection chamber" and also to prevent the passing of weapons through the portal.

Another object of the various embodiments is that it be constructed with door panels and side panels fabricated from bulletproof material such that a perpetrator who becomes trapped within the device cannot shoot their way out, or if they are carrying an explosive device, the blast will be at least partially contained if the explosive device is activated from within the access control device. A clear bulletproof material such as polycarbonate may be suitable, as well as certain composite materials such as Kevlar.

Another object of the various embodiments is to provide a provision for disabled individuals in wheelchairs to pass through. In order to do this it may be appropriate to utilize a security verification mechanism such as a card reader, fingerprint reader, or retina scan mechanism used in conjunction with the access control device—such security verification mechanisms authenticating that the individual is in fact disabled and has the right to pass through the access control device in a wheelchair.

Another object of the various embodiments is to allow a parent with child to pass together through the security access control device. A similar capability will allow a second person to accompany a disabled person through the portal. If that person is a guard carrying a weapon, a biometric device can be available to allow the guard to be properly identified and allowed to pass through along with a disabled person or child that has also been properly identified. Sensors in the portal can validate that only the persons being biometrically identified are in the portal.

Another object of the various embodiments is that the access control device can be optionally programmed so that when an alarm is set off, the door panel behind the individual opens thereby allowing the person to exit in the reverse direction. To avoid false alarms when large numbers of individuals are passing through the security access control devices during peak traffic times, the access control device may be used in conjunction with a pre-chamber where individuals who believe they might set off an alarm, possibly due to equipment they are carrying or embedded metallic medical devices in their body, can determine if they will pass successfully before attempting to pass through the access device whereby they gain entry to the building, premises, or secured area. Objects that set off the alarm can be separately screened in a security screening conveyer similar to those found at airports.

Another object of the various embodiments is that the access control device may be used in conjunction with a crowd motion sensing means, such that the directionality of individual devices within a cluster of access control devices according to this invention may be controlled from moment to moment in such a way as to match directional throughput capability of the cluster with the requirements indicated by crowd movement.

Another object of the various embodiments is that the access control device is capable of operating unattended for extended periods of time. A stack or gang of access control devices according to this invention may also operate unattended, or alternately may require only minimal attendance, for instance a single security guard who presides over a stack or gang of multiple access control devices.

Another object of the various embodiments is that the access control device may include ducting for controlled air flow such that air in the vicinity of the subject entering and within the device may be moved and passed through sensor devices which may detect chemical, biological, and/or radiological hazards.

Another object of the various embodiments is that the access control device may include ducting for controlled air flow such that air moving from within a building into the access control device is at least partially re-circulated back into the building rather than released to the outdoors, in order to conserve energy.

Another object of the various embodiments is that a single access control device may be used at an entrance by providing a bidirectional operation sequence wherein a first subject passes through in a first direction and a second subject passes through in a second direction, the first and second directions being opposite one another, and the first and second subjects being allowed to pass on successive cycles of the access control device.

Another object of the various embodiments is that the moving door panels of the access control device are suspended from sliding roof panels, and are driven from mechanisms incorporated into the moving roof panels, the moving roof panels also providing a top cover that prevents weapon passing.

BRIEF DESCRIPTION OF THE DRAWINGS

FIGS. 4A, 4B, and 4C show different moments in time during operation of the security access control device.

FIGS. 5A, 5B, and 5C show different moments in time during operation of the of a security access control device.

FIG. 13A shows a first point in time where a second door panel is positioned between a first door panel and a sidewall. FIG. 13*b* shows a second point in time where a second door panel is not positioned between a first door panel and a sidewall, and a telescoping extension is deployed to fill the space between the first door panel and the sidewall.

FIG. 17A is a top view showing multiple slots in a floor panel and a drive socket below movable by a belt or chain drive. FIG. 17B is a side view showing the anchor assembly having descended and engaged with a drive socket, the anchor assembly including a tined fork that has passed through the multiple slots shown in FIG. 17A.

FIG. 19A is a top view of a door panel and an arrangement of sprockets and belt or chain drive that are located below the floor panel. FIG. 19B is a side view cross-section where a tined fork passes through slots in the floor panel to engage with a drive socket below, the drive socket being attached to a drive belt or chain as shown in FIG. 19A.

FIG. 20B is a top view of the same door panel and drive arrangement however as viewed from above the floor panel and showing a plurality of slots in the floor panel to allow a multi-tined drive fork to pass through.

FIG. 21 also shows structures for forming slots in the floor panel.

FIG. 22 also shows structures for forming slots in the floor panel.

FIG. 27B is a cross-section side view of the embodiment of FIG. 27A, including a telescoping extension that fills a gap between a door panel and an opposite sidewall when the door panel is perpendicular to the sidewall.

DETAILED DESCRIPTION

The invention is illustrated by way of example and not by way of limitation in the figures of the accompanying drawings in which like references indicate similar elements. References to embodiments in this disclosure are not necessarily to the same embodiment, and such references mean at least one. While specific implementations are discussed, it is understood that this is done for illustrative purposes only. A person skilled in the relevant art will recognize that other components and configurations may be used without departing from the scope and spirit of the invention.

In the following description, numerous specific details are set forth to provide a thorough description of the invention. However, it will be apparent to those skilled in the art that the invention may be practiced without these specific details. In other instances, well-known features have not been described in detail so as not to obscure the invention.

In accordance with the embodiments of the invention, there are described devices and methods for controlling secure passage between two or more locations. Each of these devices can contain multiple rotatable door panels that can be positioned behind one another. In various embodiments, the door panels can be controlled by mechanized arms or other control devices in order to perform the functionality described herein.

It is noted that the term "perpendicular," as used throughout the various embodiments of this disclosure, is not necessarily limited to the precise geometrical perpendicularity of ninety degrees. Rather this term should be construed as substantially perpendicular with respect to the sidewalls and/or direction of traffic flow, so as to cause a closed position of the door panel(s) in order to block the passage of an individual or object through the security portal.

Figure 1:
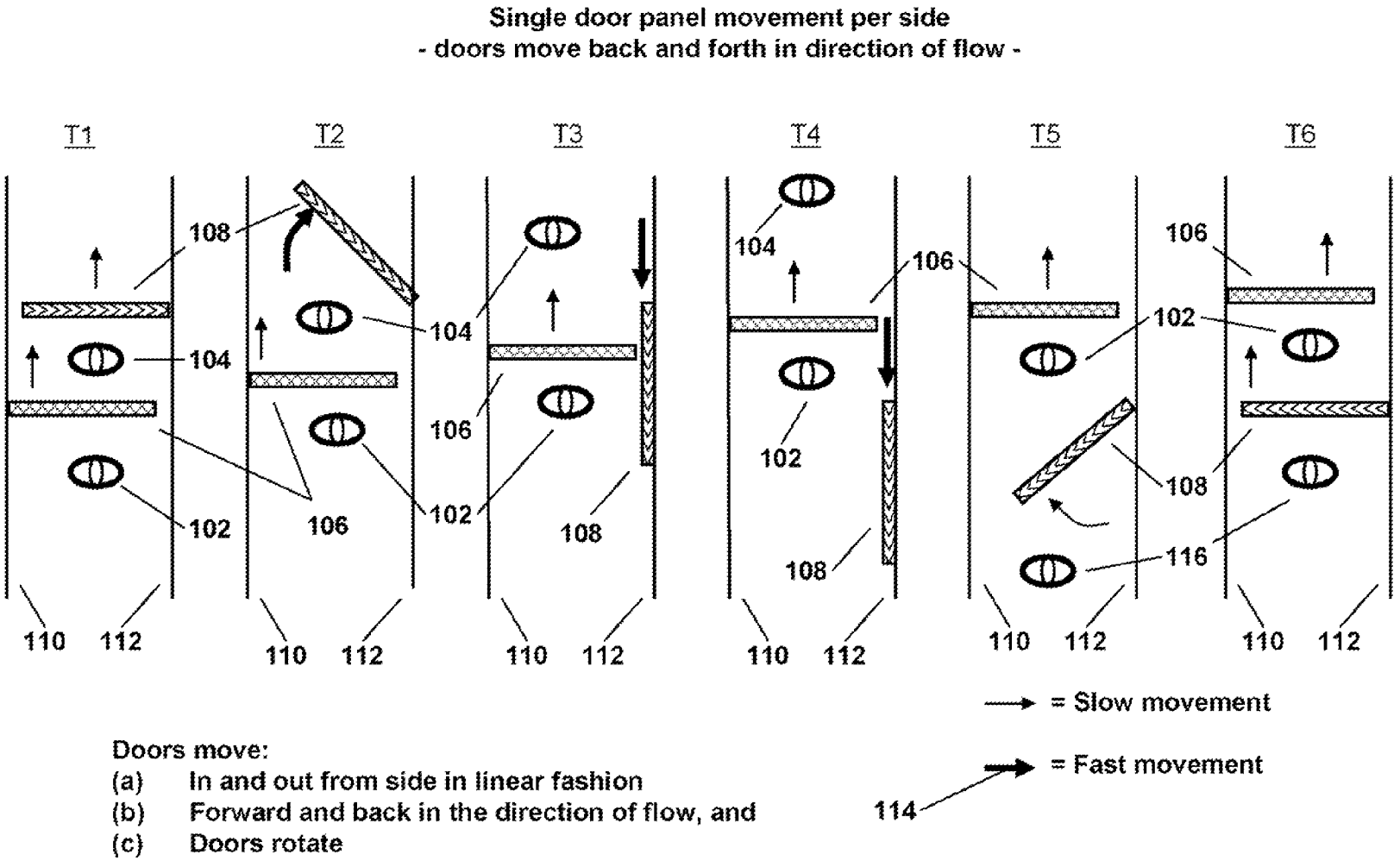
FIG. 1 is a top view illustrating functionality of an embodiment of a security access control device in accordance with the present invention.
Figures 2A, 2B:
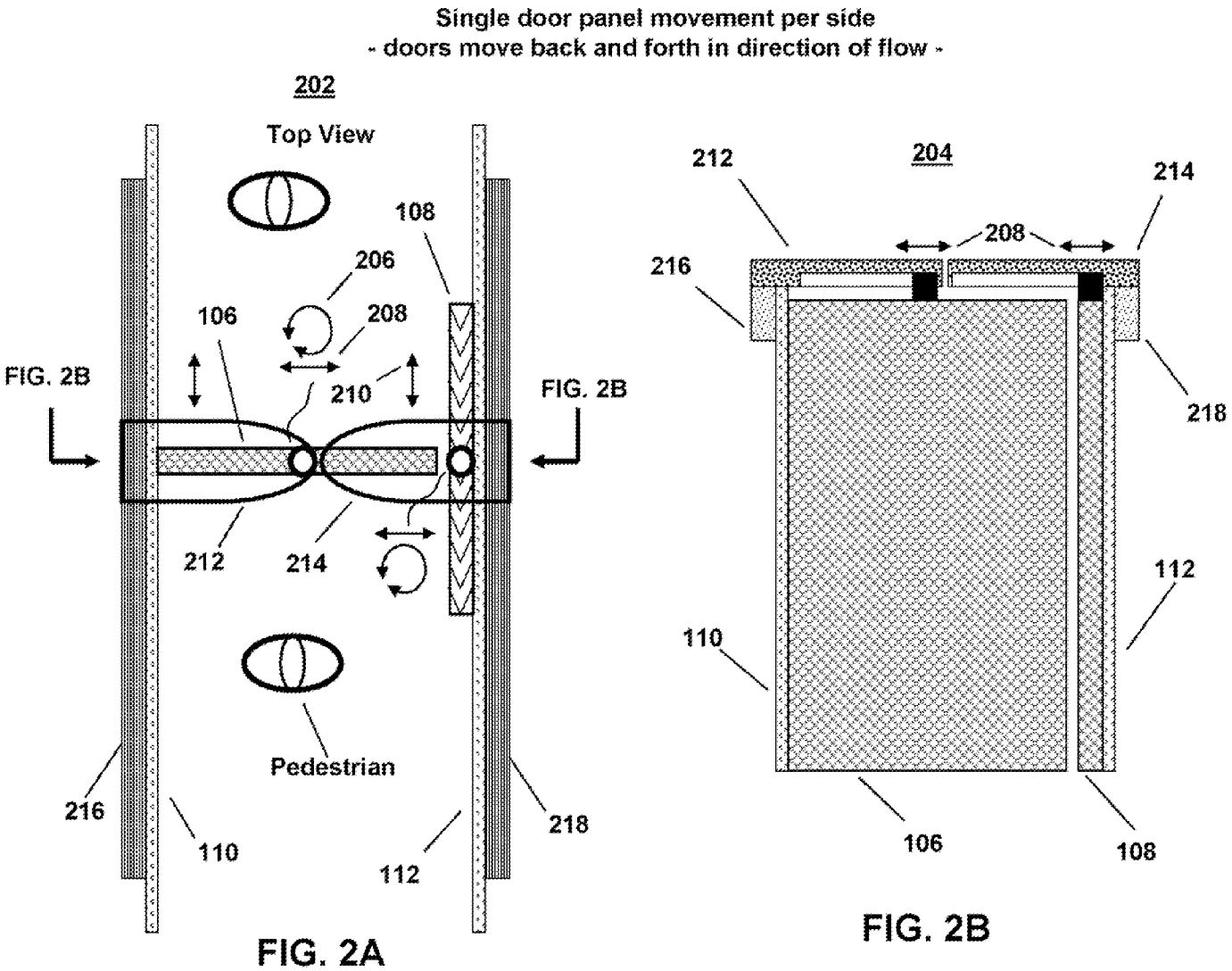
FIG. 2A is a top view and FIG. 2B is a cross-sectional view of an embodiment of a security access control device, in accordance with the present invention.
Figure 3:
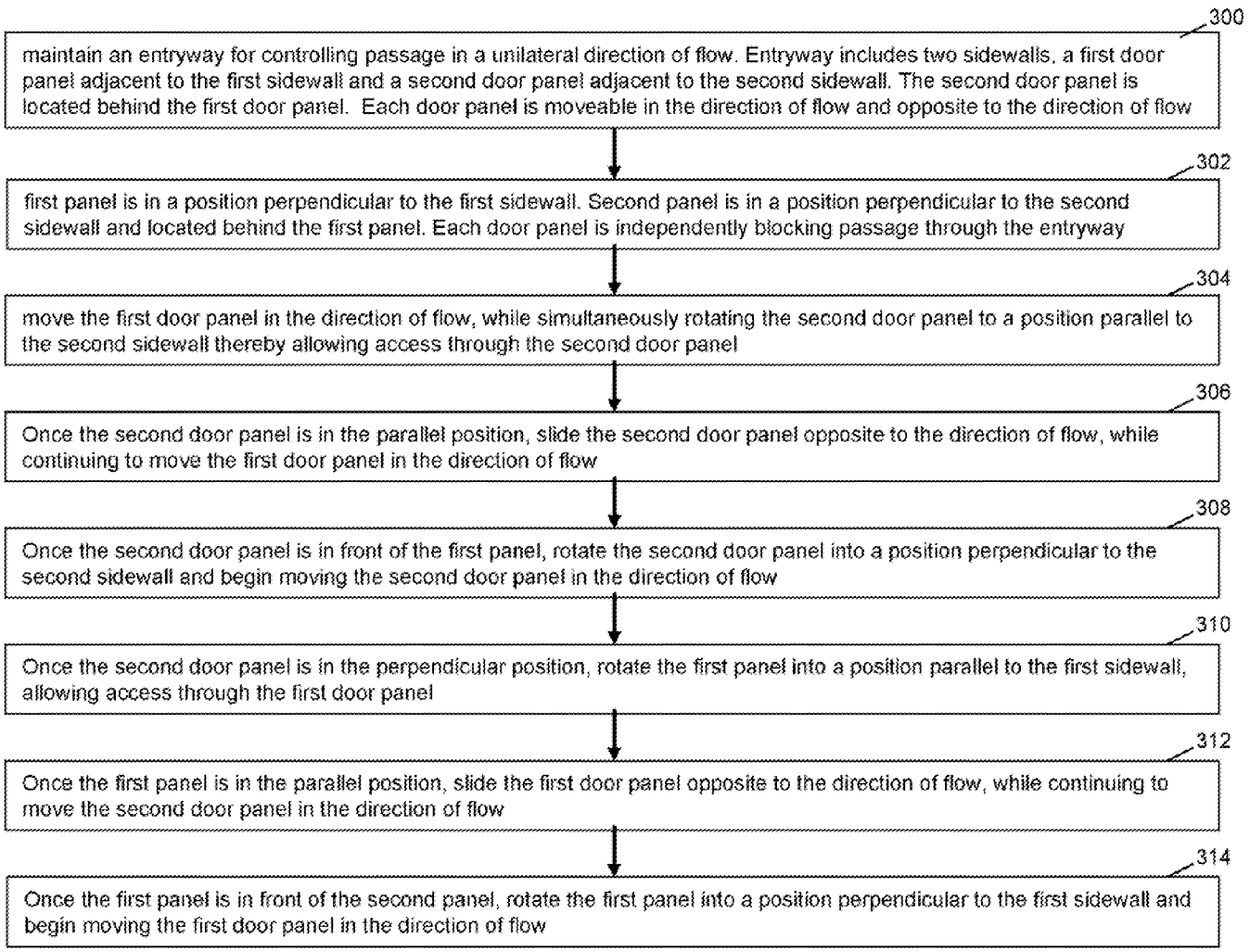
FIG. 3 is a flow chart diagram of a process for operating the security access control device of FIG. 1.

One exemplary and non-limiting embodiment for the invention is shown in FIGS. 1, 2, and 3. FIG. 1 shows the sequence of events whereby one individual 102 may be entering the access control device simultaneously with another individual 104 leaving the device, thereby enhancing throughput. In the embodiment shown in FIGS. 1 and 2, each door panel is electronically controlled to rotate 206 and move both laterally 208 and longitudinally 210 relative to the direction of flow. In timeframe T1 an individual 104 is within the access control device while another 102 is entering, and both first door 106 and second door 108 are instantaneously parallel to one another and preferably moving forward simultaneously, thus for that instant forming a detection chamber. When the moving door panels are parallel, they may move together in the direction of flow for a programmable amount of time to control the duration of time for which the detection chamber exists. In T2, second door 108 is moving forward and rotating in a manner emulating a revolving door allowing the individual 104 within the access control device to begin to exit. Simultaneously in T2, first door 106 is moving forward allowing the next individual 102 to enter. In T3, the individual 102 just entering continues to move forward behind first door 106 while second door 108 moves to become adjacent to the side panel 112 and then slides along the side panel 112 at a faster rate 114 until it is behind the person 102 currently entering as shown in T4. In T5, second door 108 now begins to rotate and move laterally in a manner emulating a revolving door, eventually assuming a position behind the person 102 who has just entered as shown in T6 where the two moving door panels 106 and 108 are instantaneously parallel to one another and thus for that instant form a detection chamber. During T5 and T6, both first door 106 and second door 108 are also moving forward in the direction of flow, thus always allowing persons entering the access control device to be continually moving. Subsequent to timeframe T6, the sequence of T1 through T6 essentially repeats, however this time second door 108 is in front of the person 116 about to enter the access control device and first door 106 is in front of the person 102 who is currently within the access control device.

Note that at certain points in the sequence of operation, there appear to be gaps between a door panel and the side panel opposite that where that door panel's control arm attaches. To prevent these gaps being used by a perpetrator for passing weapons to another perpetrator, any gaps that exist between a door panel and a side panel at any point during the motion of the door panel may be optionally filled by additional sliding panels which move adjacent to a side panel in the vicinity of a door panel and are electro-mechanically controlled such that any gap that may emerge is filled, these additional sliding "filler panels" being controlled such that their motion does not interfere with the movement of any door panel.

FIG. 2A is a top view 202 and FIG. 2B is a cross-section view 204 of an access control device according to an embodiment of the invention. Each of the panels represented as first door 106 and second door 108 is suspended from control arms shown as first arm 212 and second arm 214. These control arms contain electromechanical mechanisms which cause the attached door panel to rotate 206, and also move the door panel attachment point laterally 208 relative to the direction of flow. In addition, each control arm is capable of moving longitudinally 210, the arm being driven by an electromechanical mechanism, thereby allowing the attached door panel to be moved longitudinally as the control arm it is suspended from moves longitudinally. The control arm moves longitudinally along a track 216, 218 which is mounted at the top of the side panel 110, 112.

FIG. 3 is a flow chart diagram of the process for operating the security access control device, in accordance with the embodiment illustrated in FIG. 1. Although this figure depicts functional steps in a particular sequence for purposes of illustration, the process is not necessarily limited to this particular order or steps. One skilled in the art will appreciate that the various steps portrayed in this figure can be changed, rearranged, performed in parallel or adapted in various ways. Furthermore, it is to be understood that certain steps or sequences of steps can be added to or omitted from this process, without departing from the spirit and scope of the invention.

As shown in step 300, the device includes two sidewalls, a first panel and a second panel, as previously described. For ease of understanding, the process illustration begins with both door panels in the closed position, as shown in step 302. While both moving door panels are positioned perpendicular to the sidewalls and parallel to each other as shown in step 302, a subject enclosed between the first and second moving door panels may be scanned with one or more threat sensors to determine if they represent a threat. Should a threat be detected, the sequence of door panel movements may be subsequently altered to be different from that shown in FIG. 3 and may open the door behind the subject and allow them to exit the portal in reverse.

In step 304, the first door panel is moved in the direction of flow, while the second door panel is simultaneously rotated into a position parallel to the sidewall, allowing passage through the second door. Once the second panel is in the open position, it begins to slide in the direction opposite from the direction of flow until it passes the first door panel (step 306). At this point, the second door panel is now in front of the first door panel.

In step 308, once the second door panel is in front of the first, it rotates into a closed position (perpendicular to the sidewalls). At this point, the second door panel begins to move in the direction of flow, while being maintained in the closed position. After the second panel has been closed and is moving along the direction of flow, the first panel is rotated into an open (parallel) position, allowing passage therethrough, as shown in step 310.

In step 312, the first panel is slid opposite to the direction of flow until it passes the second panel. In the meanwhile, the second door panel continues to move in the direction of flow. In step 314, once the first panel is in front of the second panel, it is rotated back into the closed position and begins to move once again in the direction of flow. At this point, the process can loop back to step 304, where the second panel is rotated to the open position.

The process shown in FIG. 3 can continue indefinitely, or can be stopped and (re)started automatically or as needed. It should also be noted that the unidirectional traffic flow through the entryway can be reversed, as will be clearly evident to one of ordinary skill in the art in light of this disclosure.

Figures 4A, 4B, 4C:
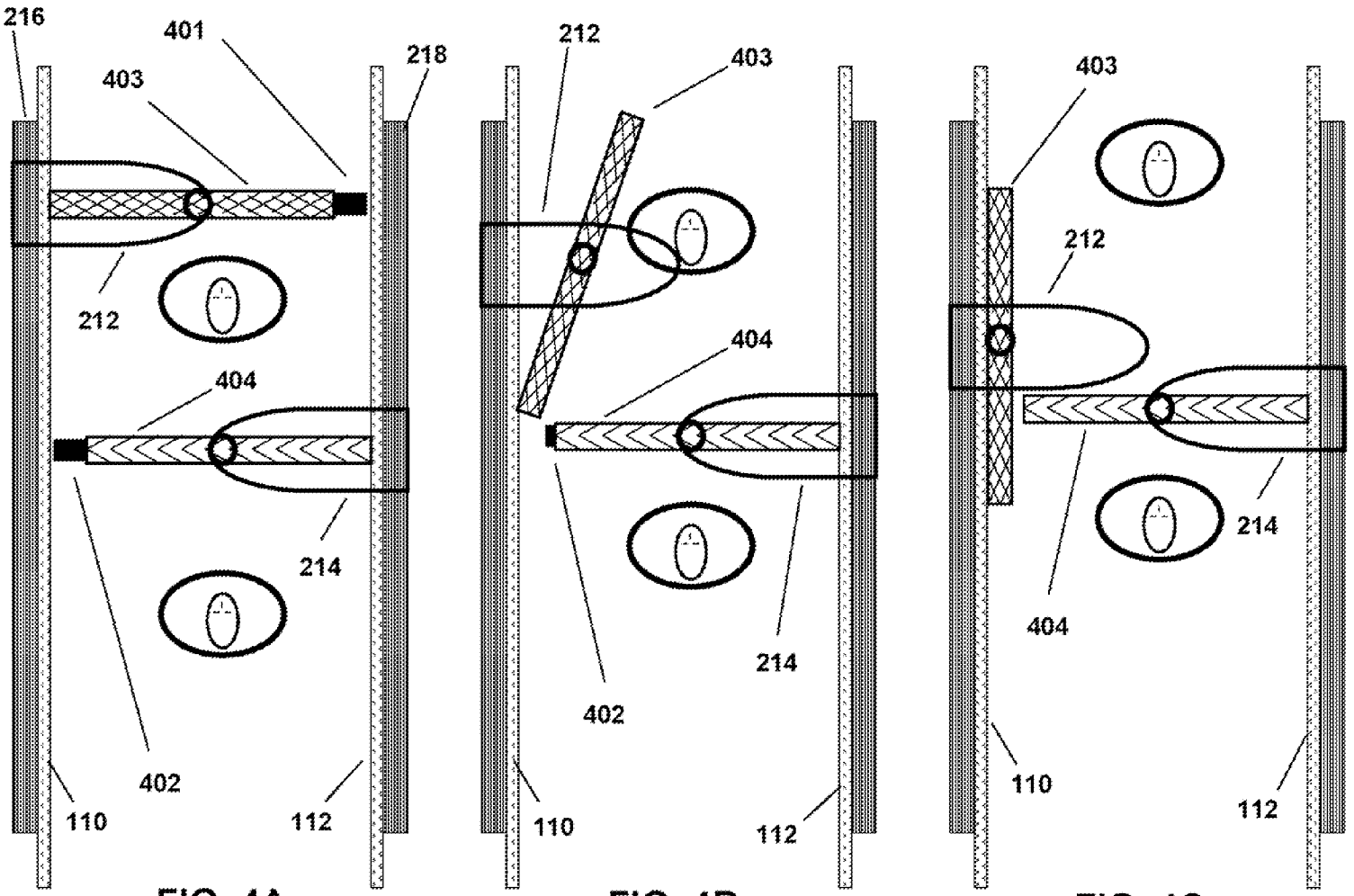
FIGS. 4A-4C illustrate an embodiment of a method and device for filling a gap between a moving door panel and a sidewall of a security access control device in accordance with the present invention.

As mentioned earlier, it can be preferable that there not be a moment in time where a gap exists that would allow passage of even a small weapon (for instance a small gun or grenade) through the portal. As shown in FIGS. 4A-5C it can be desirable to have means for filling the gap between a moving door panel and a sidewall. Thus, the scenario may be prevented where two or more subjects work together such that a first subject who does not carry a weapon may pass through the portal first, and subsequently a second subject might toss a weapon through the gap in the portal to the first subject who is already on the inside of the facility being protected by the portal. For the embodiment of FIG. 1 where each moving door panel must occasionally pass alongside the other moving door panel during operation of the portal, there must be a gap available for this passage to occur. As shown in FIG. 4A, this gap is filled by telescoping extensions 401 and 402 that project from door panels 403 and 404 respectively under control of the portal's control system. In FIG. 4B, as door panel 403 moves closer to a position parallel with the sidewall, telescoping extension 402 starts to withdraw into door panel 404 to create a gap for panel 403 to pass. In FIG. 4C, door panel 403 is now parallel and adjacent to the sidewall and is passing alongside door panel 404, telescoping extension 402 having now been completely withdrawn into door panel 404.

Figure 5C:
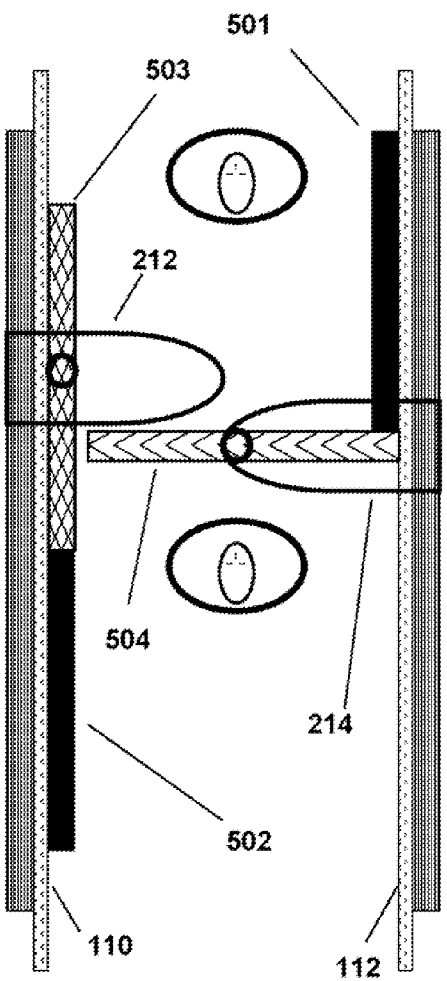
FIGS. 5A-5C illustrate an alternative embodiment of a method and device for filling a gap between a moving door panel and a sidewall of a security access control device in accordance with the present invention.
Figure 5B:
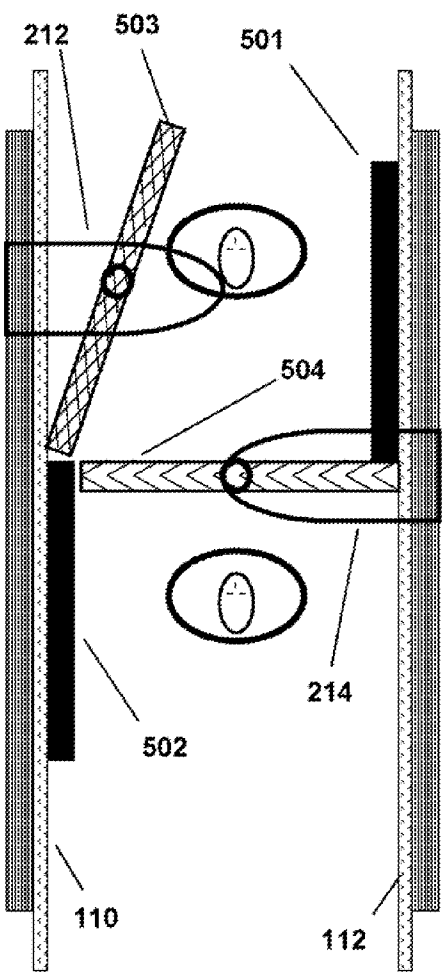
Figure 5A:
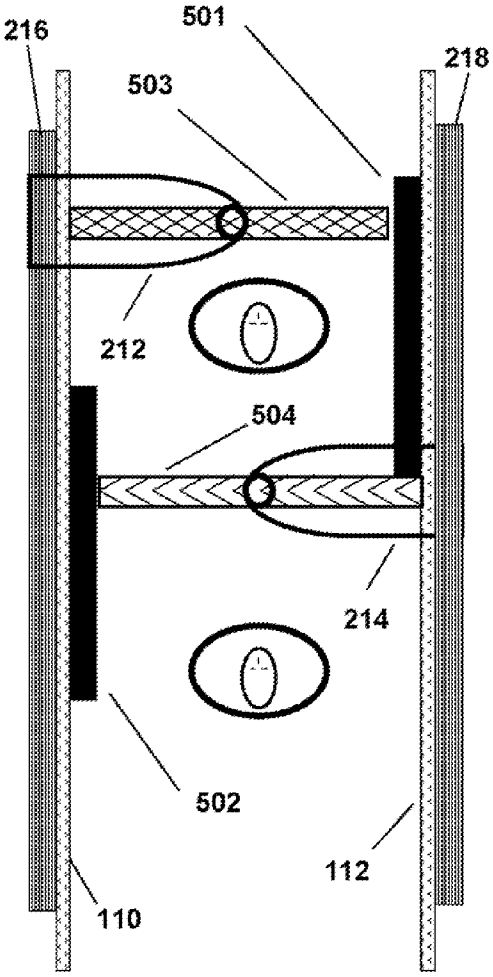

A similar scenario exists in FIGS. 5A-5C where sliding filler panels 501 and 502 performing similar tasks to the telescoping extensions of FIGS. 4A-4C. In FIG. 5A, sliding filler panels 501 and 502 fill the gaps adjacent to door panels 503 and 504 respectively. In FIG. 5B, door panel 503 is moving towards the sidewall and starting to pass through the gap adjacent to door panel 504, while sliding filler panel 502 is beginning to withdraw from the gap which door panel 503 will shortly occupy. In FIG. 5C, door panel 503 is now fully adjacent to the sidewall and is in the gap adjacent to door panel 504, filler panel 502 having withdrawn to allow the passage of door panel 503. At another point in the sequence of operation, sliding filler panel 501 performs a similar function to filler panel 502, moving aside to allow door panel 502 to pass through a gap between door panel 503 and the opposite sidewall.

Figure 6:
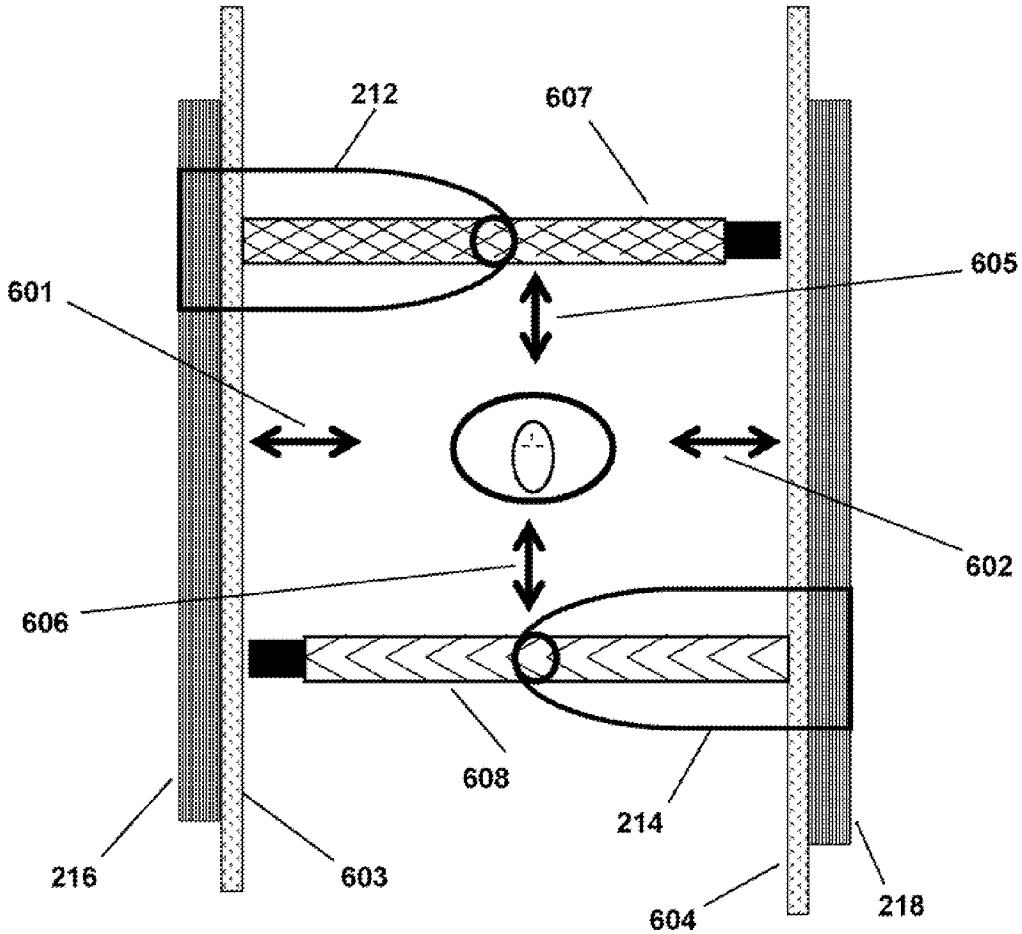
FIG. 6 is an illustration of imaging sensors and emitters usable with embodiments of moving door panels and side panels in accordance with the present invention.

As shown in FIG. 6, when moving door panels 607 and 608 are parallel, a detection chamber is formed with side walls 603 and 604 forming the other two walls of the chamber. In addition to conventional metal detection technologies, and various chemical, explosive, and bio-detection technologies, there are imaging technologies which may be employed to observe the subject, the subject's clothing, and objects that the subject may be carrying whether concealed or visible. For example, various radio frequency (RF) imaging technologies exist such as ultra-wideband (UWB) radar and whole body imaging (WBI) technologies exist such as millimeter wave scanner and backscatter x-ray that enable a view of the subject that penetrates any clothing to reveal shapes that may correspond to the shape of various weapons. Emitters and/or detectors for these imaging technologies may be located in both the moving door panels and the side panels, and the paths of RF and x-ray radiation within the detection chamber may be represented by arrows 601 and 602 when emitters and/or detectors are mounted in the side walls, and by arrows 605 and 606 when emitters and/or detectors are mounted in the moving door panels. Note that the moving door panels may be continuously rotated 360.degree. in either direction, and that depending upon their position in the operational sequence when a detection chamber is created, either side of a moving door panel may in fact be facing the detection chamber. Thus, any imaging emitters and/or detectors mounted on a moving door panel should be mounted redundantly on both sides of the door panel.

Similarly, video cameras for optical imaging of a subject may be mounted both sides of the moving door panels and optionally on the side walls as well. Video imaging may be included such that a subject's face may be observed as they walk through the access control device. Observing and analyzing the expressions on a subject's face have been shown to offer clues as to a subject's state of mind—especially when they are contemplating a violent act and/or self-destruction. To ensure that the subject's face is properly viewed such that the image can be properly analyzed by computer, the system can prompt a subject—by voice or signage or both—to look straight ahead for consistent and proper video capture. When thus prompted, if the subject does not comply, the system may optionally stop allowing forward progress of the subject until they comply, or alternately may deny passage and back them out of the portal.

As a further aid to monitoring the position of a subject passing through the portal and further to ensure the number of subjects within the portal, position detection may also be performed by mounting emitters and/or sensors in either the floor or top cover of the portal or both. These positions sensors may be of IR, sonic, or some other technology.

Figure 7:
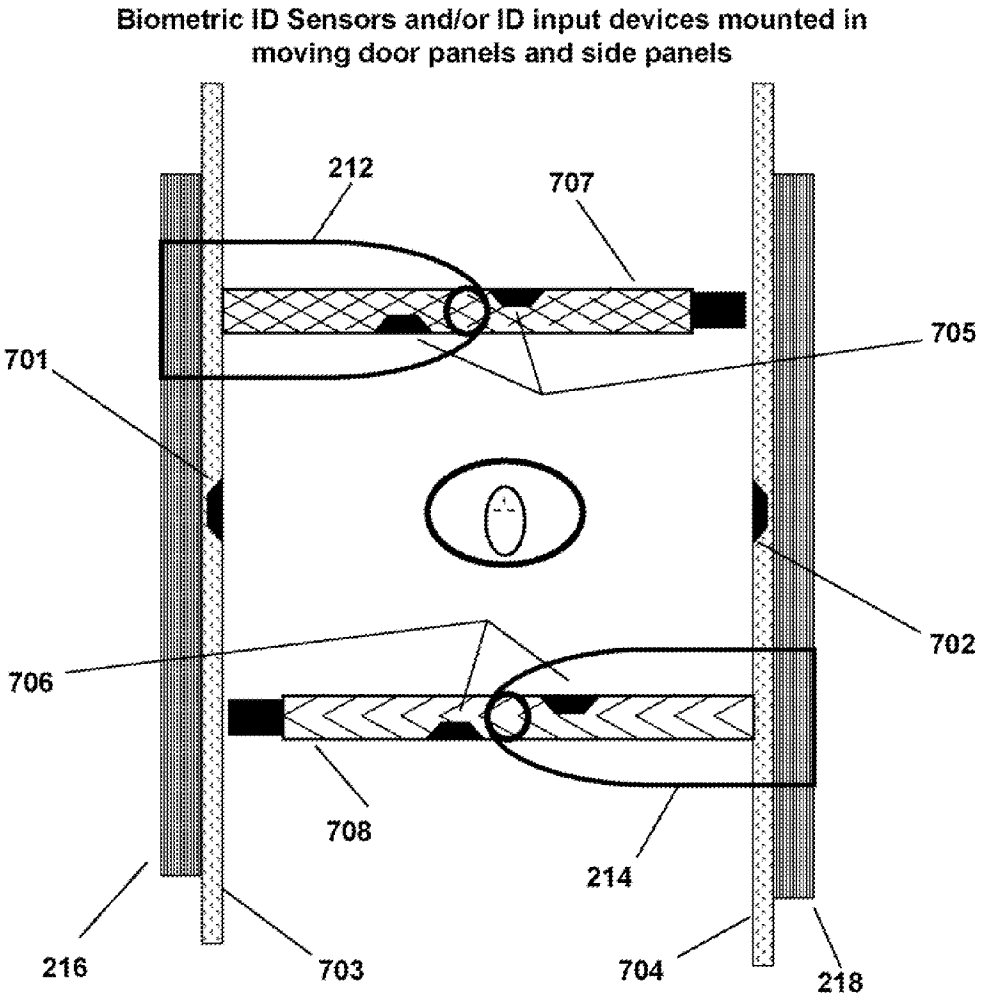
FIG. 7 is an illustration of biometric ID sensors and/or ID input devices usable with embodiments of moving door panels and side panels in accordance with the present invention.

At times, it may be useful to identify a subject who is within the detection chamber of an access control device according to this invention. This circumstance may occur if a security guard wishes to pass through the portal and is carrying a weapon. As shown in FIG. 7, to allow this person to pass, the operational sequence of the portal may pause at the point where the moving door panels 707 and 708 are parallel forming a detection chamber. The subject may then interact with a biometric detection device such as 705 and 706 located in a moving door panel, or 701 and 702 located in sidewalls 703 and 704 respectively. A common way to perform this biometric validation would be a fingerprint identification mechanism. Alternately, or in combination, a device capable of performing a retinal scan may also be included. Thus, if the system confirms that there is only one person in the detection chamber and that person is positively identified as being allowed to pass while caring a weapon, the sequence of operation of the portal will continue and allow the person to enter the secured area. Another circumstance where biometric specification is useful is to identify disabled persons that may need to pass through the portal along with various metallic devices such as a wheelchair, crutches, or cane. Again, if this person is certified to be safe to pass and the detection mechanisms in the detection chamber within the portal determine that only this person is present and they are validated, then the operation of the portal may proceed further and allow them to pass. Yet another circumstance may arise where a security guard may assist a disabled person or child in passing through the portal. Again, the security guard can identify themselves to the biometric sensing system and be allowed to pass along with the person they are escorting.

Although typically described herein as supporting a unidirectional traffic flow, a portal according to the invention may also be used for bidirectional traffic where successive subjects may travel through the portal in different directions. Once activated to allow a subject to pass, travel is unidirectional for that subject. When two subjects approach a portal simultaneously from two different directions, arbitration for deciding which subject is allowed to pass first may be decided by a number of well understood mechanisms. These include sensor systems that determine which subject approach the portal first, and/or sensor systems that determine the number of subjects queued for passage on each side of the portal and subsequently decide which direction of passage to allow first based on the greater demand.

Figure 8:
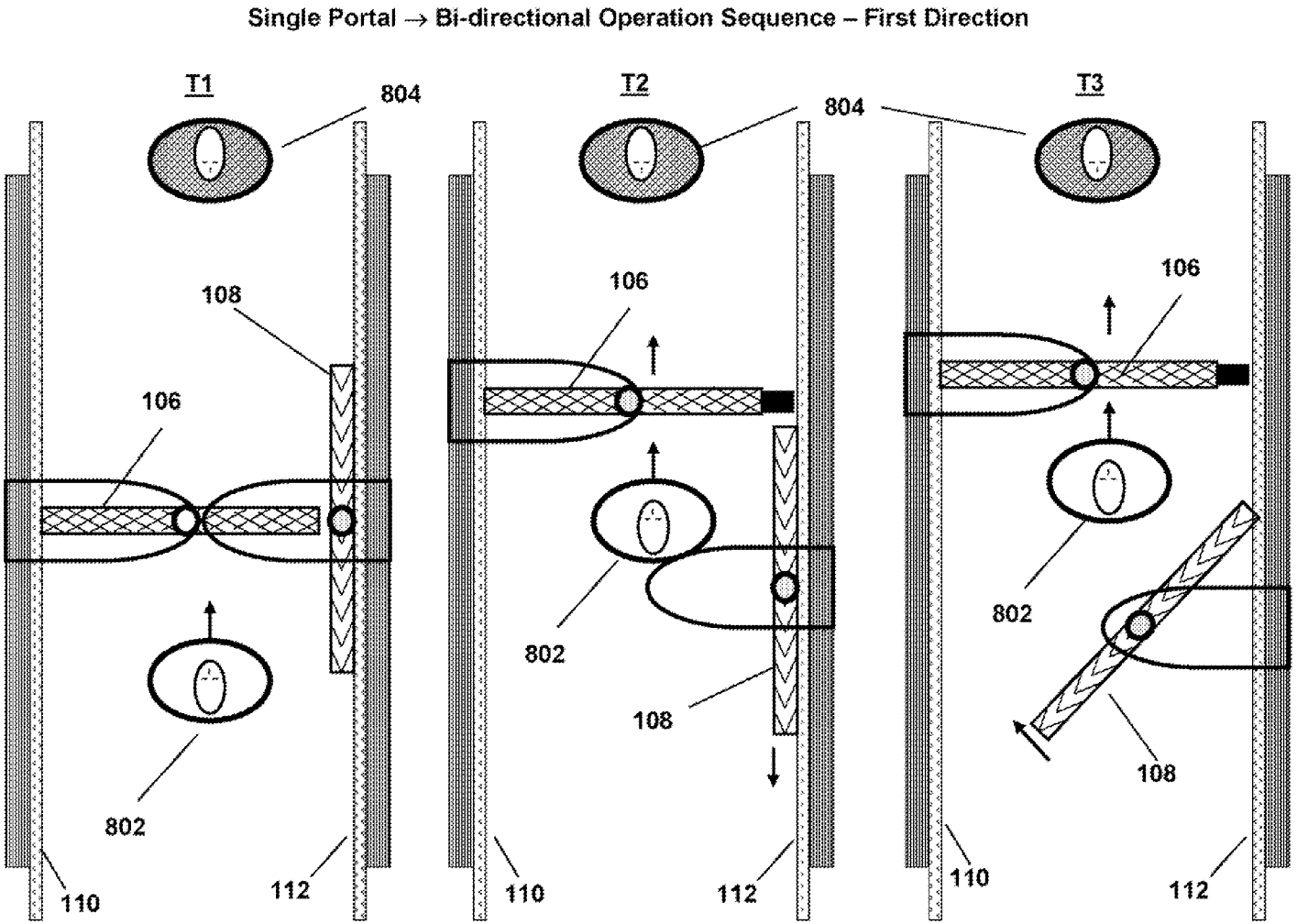
FIG. 8 is the first of four figures that demonstrate a bi-directional operation sequence for an embodiment of a single linear revolving door (LRD) Portal in accordance with the present invention.
Figure 9:
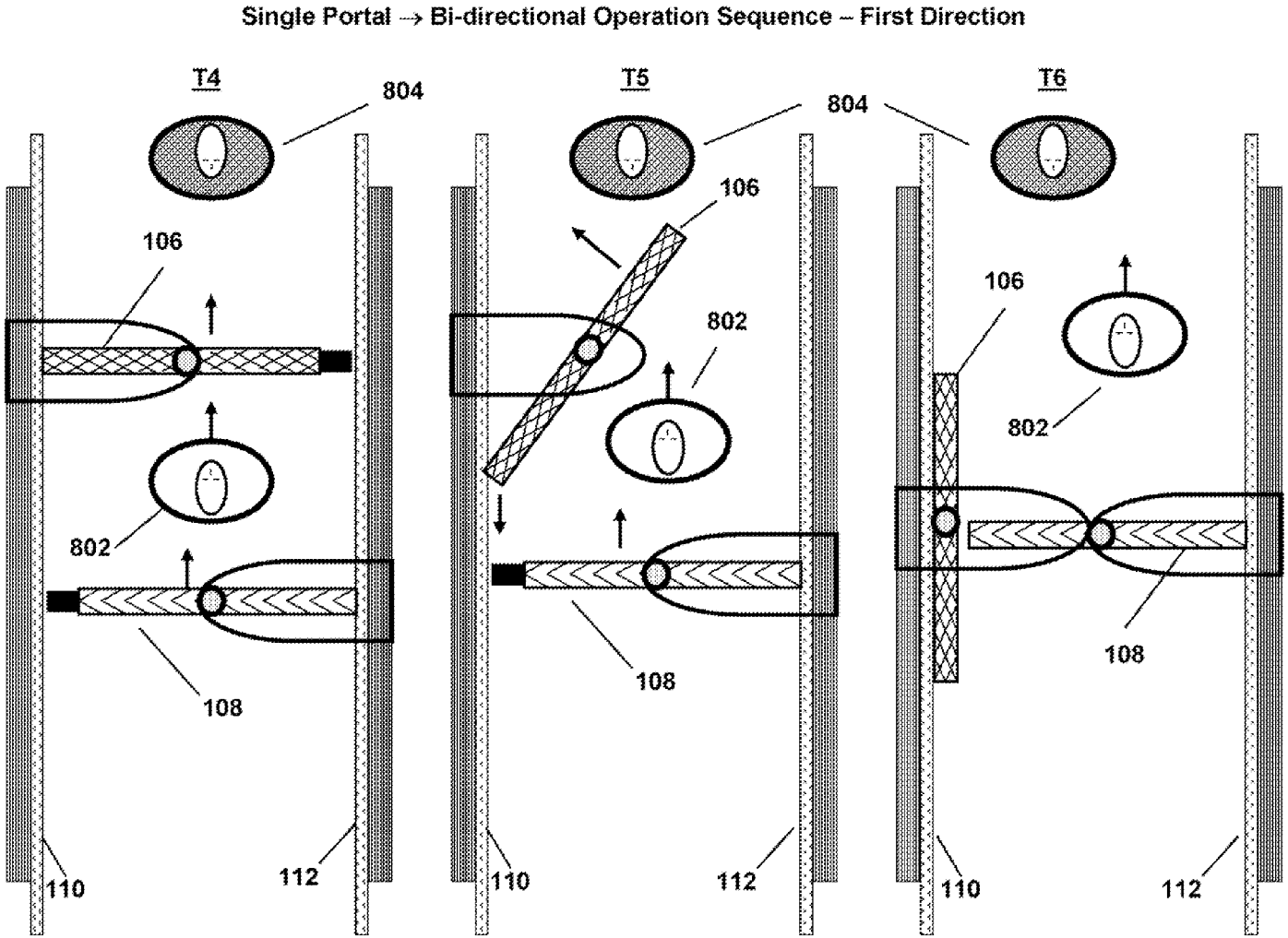
FIG. 9 is the second of four figures that demonstrate a bi-directional operation sequence for an embodiment of a single LRD Portal in accordance with the present invention.

For bidirectional operation, a portal starts in a neutral position where according to timeframe T1 in FIG. 8, a first door panel 106 is oriented perpendicular to the sidewalls and is separated from sidewall 112 by a second door panel 108. From this neutral starting position, passage in either direction can begin. Next in timeframe T2, a first subject 802 begins passage in a first direction with door panel 106 moving forward in front of them, and door panel 108 moving in a reverse direction adjacent to sidewall 112. Next in timeframe T3, door panel 106 continues to move forward while door panel 108 starts to swing behind subject 802. In timeframe T4 of FIG. 9, both door panels 106 and 108 are perpendicular to the sidewalls, for an instant forming a detection chamber. At this point in time if the subject 802 is traveling in a direction where security must be maintained, passage will be blocked if a weapon is detected and subject 802 would typically the allowed to reverse direction and back out of the portal with door panel 108 opening to allow such reverse travel. In timeframe T5, door panel 106 swings open allowing subject 802 to begin to exit the portal while door panels 108 and 106 have assumed a neutral starting position similar to timeframe T1 except that now door panel 108 is positioned perpendicular to the sidewalls and door panel 106 is positioned adjacent sidewall 110 and between door panel 108 and sidewall 110. From this neutral starting position passage by a second subject 802 may begin in a second direction which is opposite the first direction, as further described in FIGS. 10 and 11.

Figure 10:
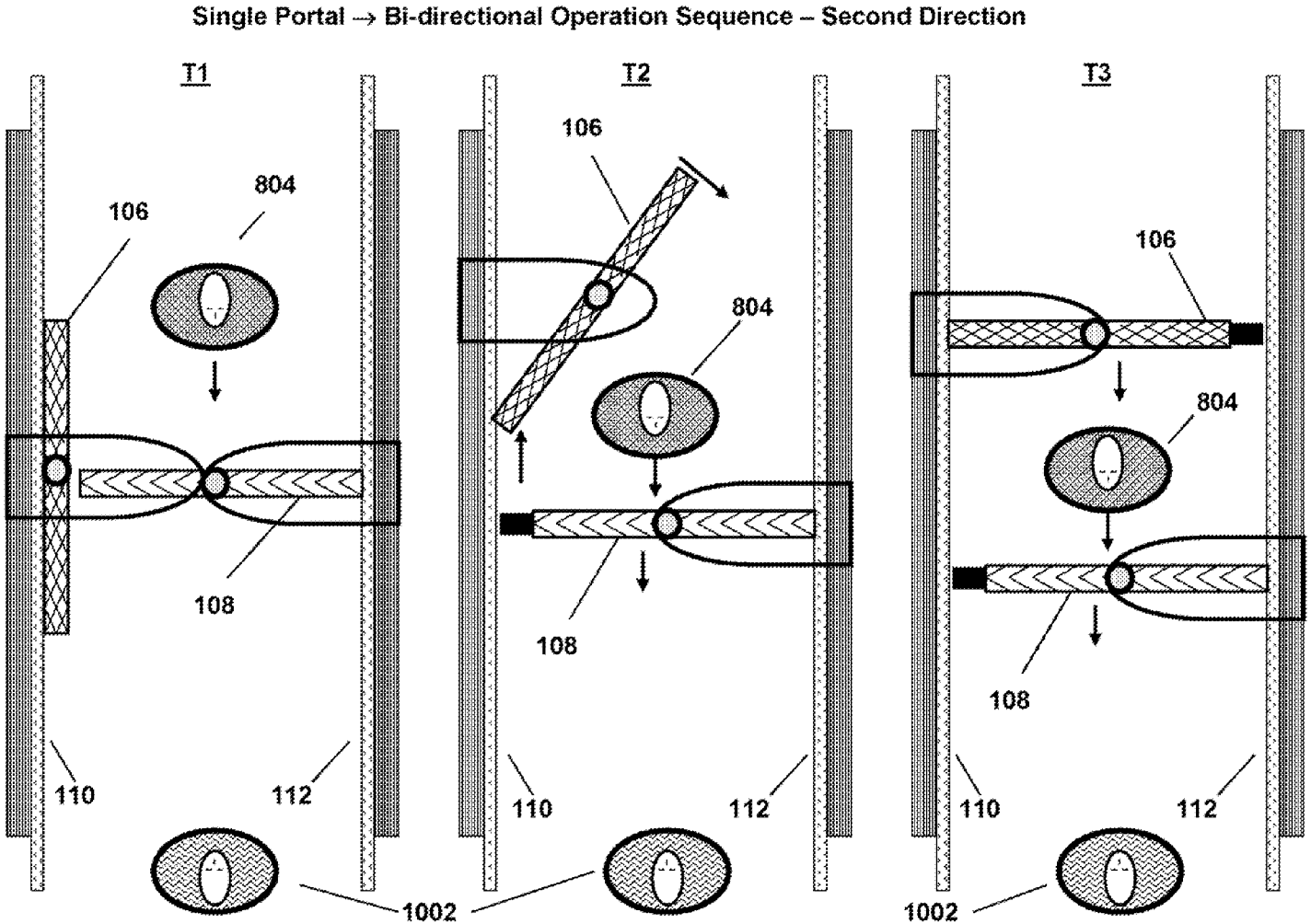
FIG. 10 is the third of four figures that demonstrate a bi-directional operation sequence for an embodiment of a single LRD Portal in accordance with the present invention.
Figure 11:
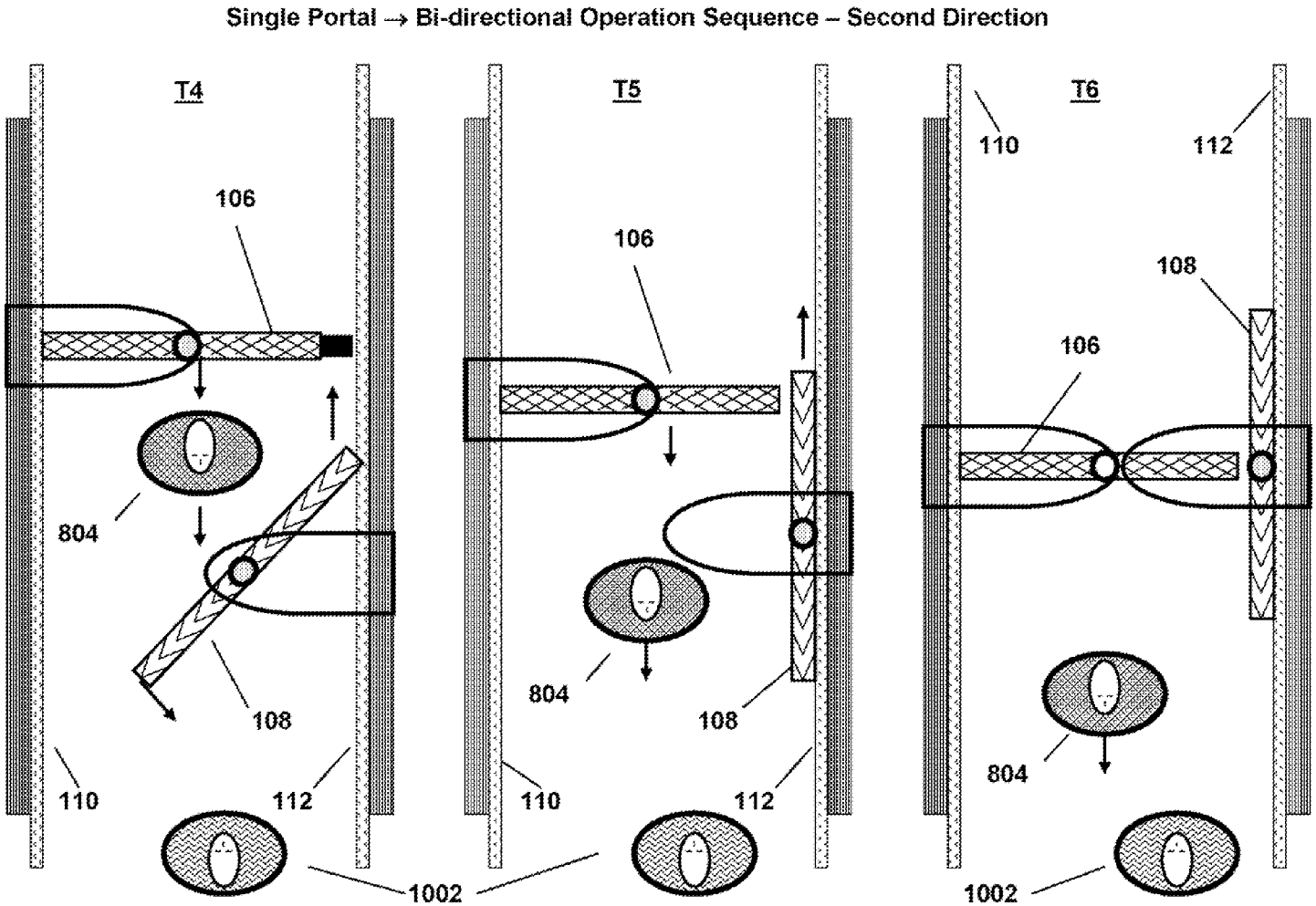
FIG. 11 is the fourth of four figures that demonstrate a bi-directional operation sequence for an embodiment of a single LRD Portal in accordance with the present invention.

Shown in time frame T1 of FIG. 10, subject 804 approaches the portal traveling in a direction which is the reverse of that previously traveled by subject 802. Here, the door panels are positioned in the neutral starting position with panel 108 perpendicular to the sidewalls and panel 106 adjacent sidewall 110. Subsequently in timeframe T2, door panel 106 slides in a reverse direction relative to that of subject 804's direction of travel and begins to rotate around behind subject 804. Next in timeframe T3, door panel 106 has rotated to a position perpendicular to the door panels and for a moment both door panels are likewise perpendicular to the sidewalls forming a detection chamber. If the direction of travel of subject 802 was the direction where security is maintained, then typically the reverse direction traveled by subject 804 would be a direction where security is not necessary and as such no threat detection test would be performed while the detection chamber of timeframe T3 is temporarily formed. Next in timeframe T4 of FIG. 11, door panel 108 begins to swing open allowing subject 804 to begin to exit the portal. Subsequently in timeframe T5, door panel 108 has become positioned adjacent to sidewall 112 and is sliding in a reverse direction relative to the direction of travel of subject 804. Last in timeframe T6, door panels 106 and 108 have again assumed a neutral position where this time door panel 106 is perpendicular to the sidewalls, and door panel 108 is parallel to sidewall 112 and is positioned between door panel 106 and sidewall 112. Therefore, a demonstration of bidirectional travel through a single portal according to the invention has been described with respect to FIGS. 8 through 11.

Embodiments described with respect to FIGS. 2A and 2B and FIGS. 4A through 11 showed door panels suspended from and driven by mechanisms attached to moving arms such as 212 and 214. When moving arms are utilized as such they do not fully seal the top of the portal and therefore some form of top cover must be added. Mechanisms or components must then also be added to seal gaps above the door panels to prevent weapon passing when two or more attackers work in unison.

In an alternative embodiment as shown in FIGS. 12A through 16, each moving arm of previous figures is replaced with a sliding roof panel from which a door panel is suspended and driven. The rotational drive mechanism for a door panel is moveable laterally with respect to the sliding roof panel, for example with the drive mechanism recessed into a groove on the underside of the roof panel and being moveable laterally within the groove. The two sliding roof panels abut each other and together form a surface that seals the top of the portal to prevent weapons from being passed over a door panel.

Figure 12A:
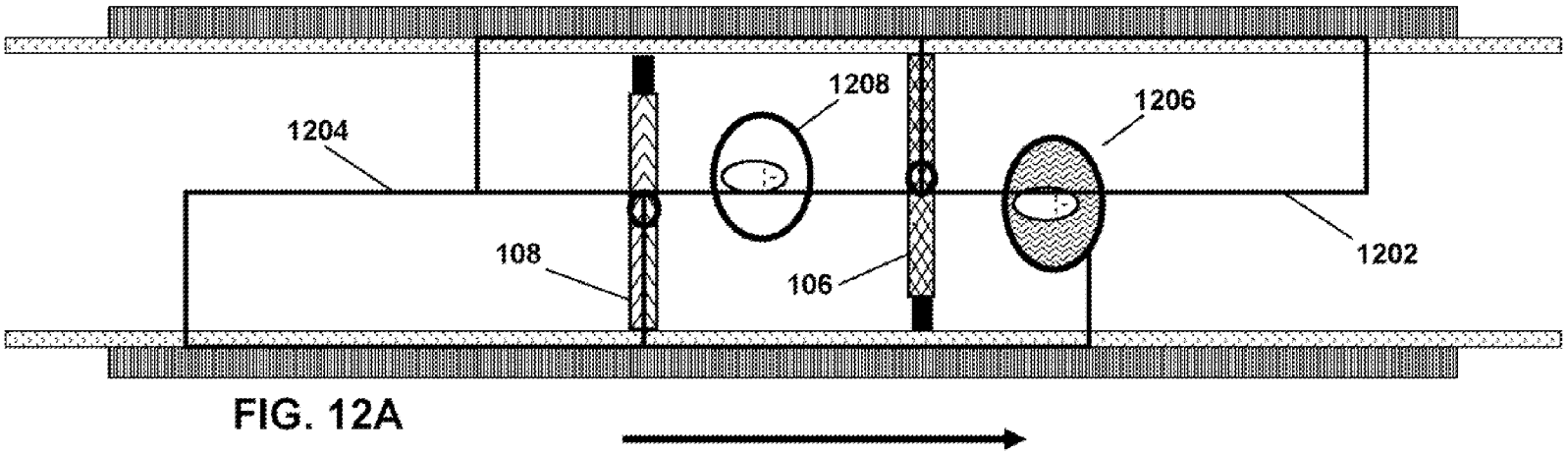
FIGS. 12A and 12B are top views of an embodiment of an LRD Portal in accordance with the present invention wherein sliding roof panels have replaced the moving arms of previous embodiments.
Figure 12B:
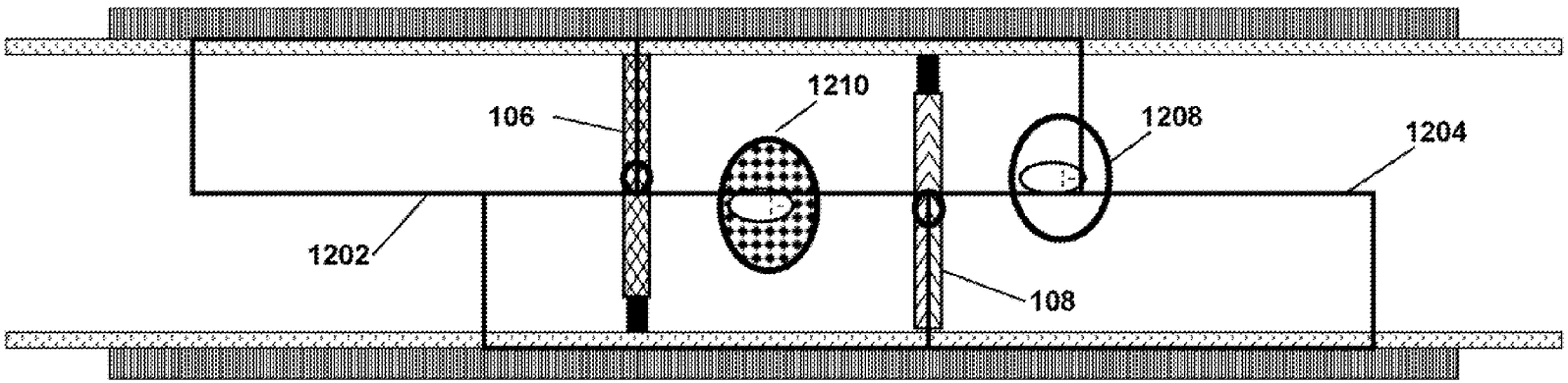

FIGS. 12A and 12B are top views of a portal according to the invention including sliding roof panels which support and drive door panels 106 and 108. Each of FIGS. 12A and 12B is shown with the sliding panels at an extreme position of movement. In FIG. 12A subject 1206 is just exiting the portal and subject 1208 is in the detection chamber between door panels 106 and 108. Here, sliding roof panel 1202 is at an extreme position in the forward direction while sliding roof panel 1204 is in an extreme position towards a rearward direction. FIG. 12B shows just the opposite. Here subject 1208 is now exiting the portal and subject 1210 is in the detection chamber between door panels 106 and 108. In FIG. 12B sliding roof panel 1202 is now at an extreme position towards the entrance side of the portal while sliding roof panel 1204 is at an extreme position on the exit side of the portal. Note that even at the extreme positions the sliding roof panels form a cover over one or more door panels and therefore sealing the portal against an attacker who might attempt to toss a weapon over the top of a door panel.

Figures 13A, 13B:
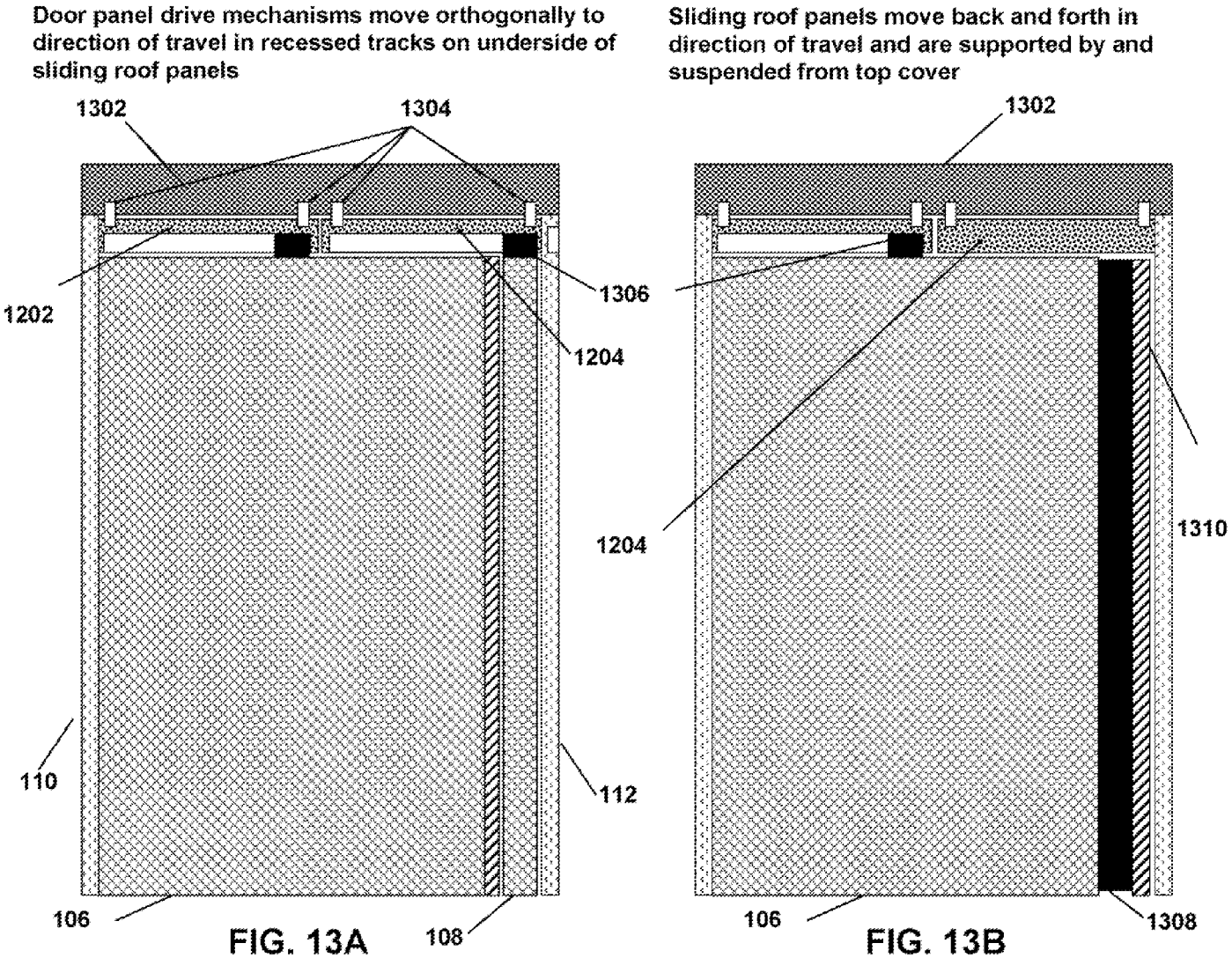
FIGS. 13A and 13B are cross-section views of an embodiment of an LRD Portal in accordance with the present invention wherein sliding roof panels have replaced the moving arms of previous embodiments.

FIGS. 13A and 13B are cross-section views of a portal with FIG. 13A showing a cross-section at one point in the operational sequence while FIG. 13B shows a cross-section at another point. In FIG. 13A, door panel 106 is perpendicular to the sidewalls and door panel 108 is parallel to the sidewalls and positioned between door panel 106 and the opposite sidewall. In FIG. 13B, door panel 106 is still perpendicular to the sidewalls however door panel 108 is not shown since it is not positioned to be visible at the particular cross-section. In FIG. 13B, telescoping extension 1308 and seal 1310 are visible since door panel 108 is not included in the cross-section and therefore the space between door panel 106 and the opposite sidewall must be temporarily filled. Note that each moving door panel in FIGS. 13A and 13B contains two extensions such as 1308 since for each successive movement cycle of a door panel, a different side of the panel is typically oriented facing the gap between the panel and the opposite sidewall. The same is true for all embodiments described herein where any telescoping extension is shown for a moving door panel. Note also in both FIGS. 13A and 13B that sliding roof panels 1202 and 1204 support and drive door panels 106 and 108 respectively through drive mechanisms 1306 which in addition to rotating a door panel, are each movable laterally along the groove recessed into the respective sliding roof panel. Note that each sliding roof panel is suspended by suspension bearings 1304 from top cover 1302 which supports the sliding roof panels. Drive mechanisms are also included (not shown) that drive each sliding roof panel individually in a longitudinal direction parallel to the sidewalls.

Figure 14A:
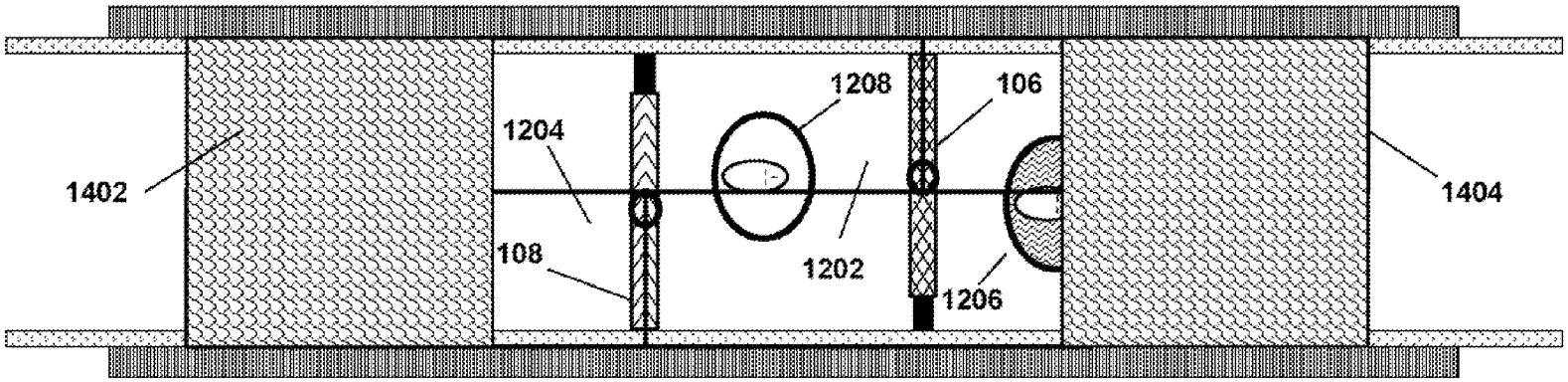
FIGS. 14A and 14B are top views of an LRD Portal where sliding roof panels have replaced the moving arms of previous figures, and receptacles are added to fill areas that may become open above when sliding panels are at extreme positions. For FIG. 14*a* the receptacles are shown, and in FIG. 14*b* the receptacles are transparent.
Figure 14B:
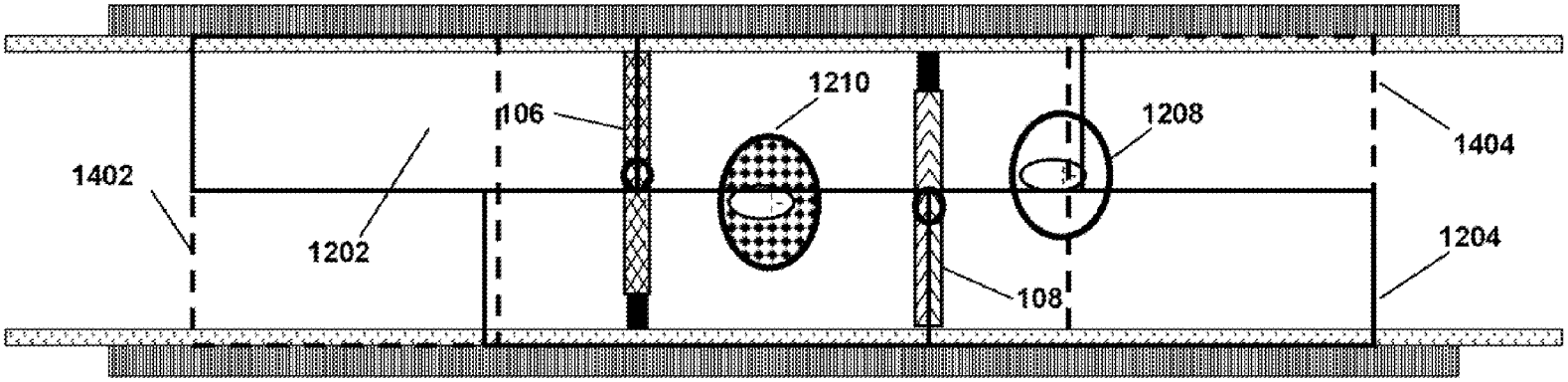

In most scenarios the sliding roof panels are sufficient to cover the tops door panels at all positions in their travel, however should it arise for a particular implementation that space is opened up above a door panel at some extreme movement of a sliding roof panel, that space may be filled by a receptacle which is added to the assembly according to FIGS. 14A and 14B and serves to fill the open space above a door panel when necessary. FIGS. 14A and 14B correspond to FIGS. 12A and 12B with regard to subjects passing through and to positions of sliding roof panels, except that receptacles 1402 and 1404 have been added. In FIG. 14A receptacles are fully shown, and in FIG. 14B receptacles are shown with dotted outline such that the position of the sliding roof panels can also be seen.

Figure 15:
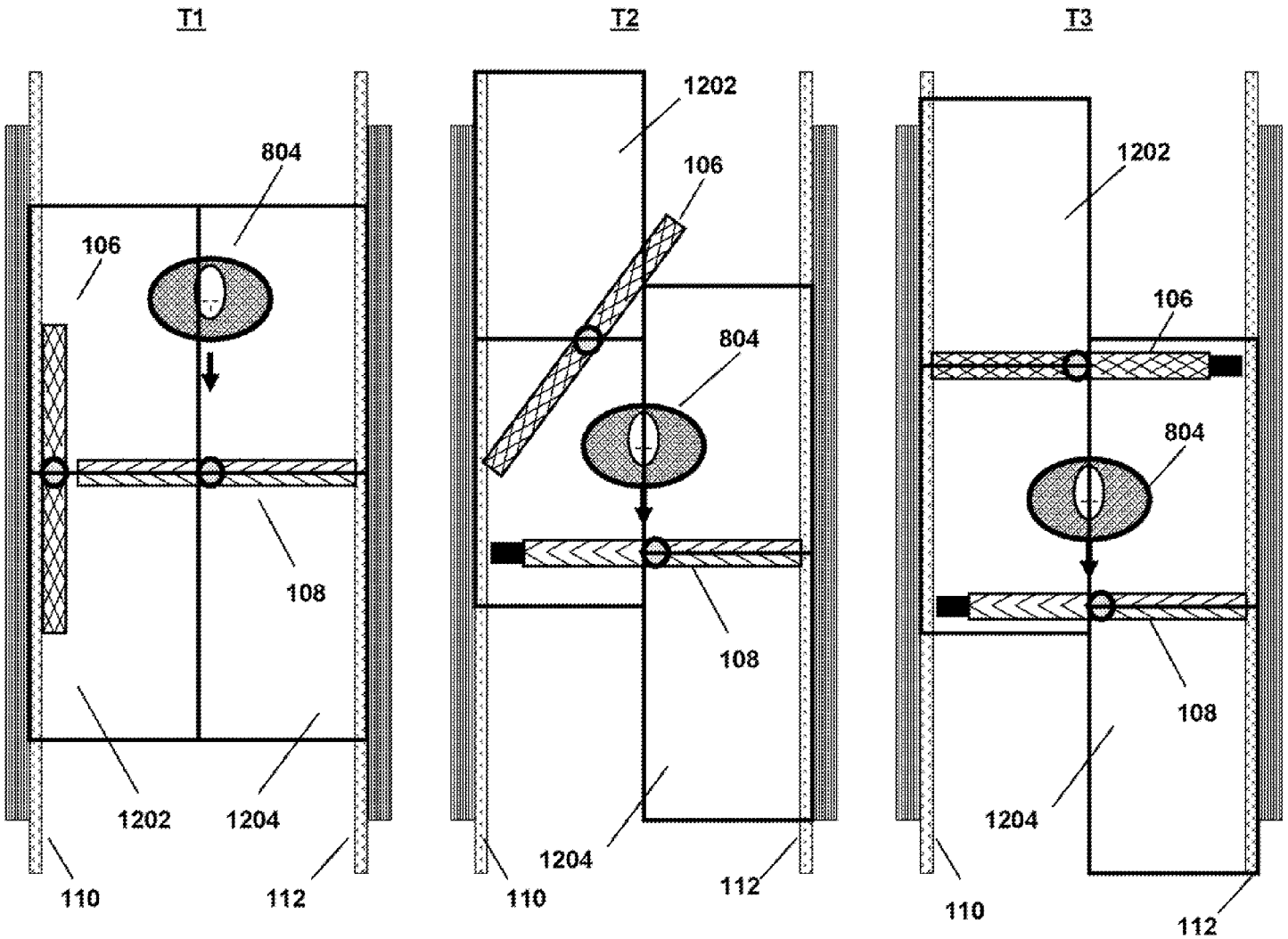
FIG. 15 is the first of two figures showing top views that demonstrate a sequence of operation for an embodiment of an LRD Portal in accordance with the present invention wherein moving door panels are suspended from and driven by mechanisms attached to sliding roof panels.
Figure 16:
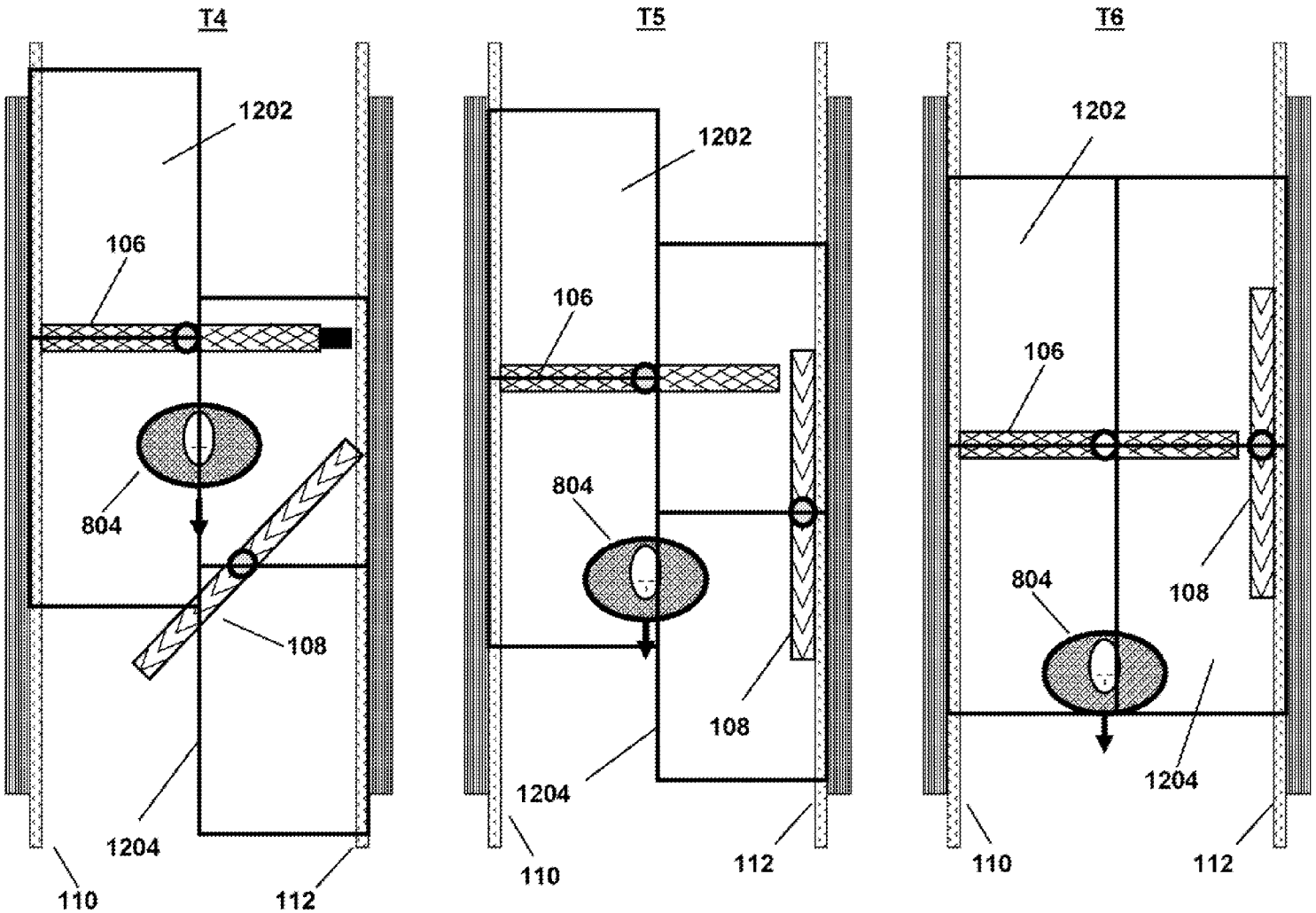
FIG. 16 is the second of two figures showing top views that demonstrate a sequence of operation for an embodiment of an LRD Portal in accordance with the present invention wherein moving door panels are suspended from and driven by mechanisms attached to sliding roof panels.

FIGS. 15 and 16 are top views of a portal with sliding roof panels during a sequence where one subject 804 passes through. This sequence demonstrates that an implementation of sliding roof panels will successfully provide a top cover for at least one perpendicular door panel at all times, and as such prevent weapon passing when two or more attackers work in unison. The sequence starts with a neutral position at timeframe T1 similar to the starting point at T1 in FIG. 10. An extreme rearward position for sliding roof panel 1202 is reached in timeframe T2, while an extreme forward position is reached for sliding roof panel 1204 in timeframe T4 of FIG. 16. During a subsequent cycle, the extreme positions of each sliding roof panel would essentially mirror those shown in FIGS. 15 and 16, thus demonstrating that at all times the sliding roof panels effectively provide a top cover to prevent weapon passing.

Figure 17B:
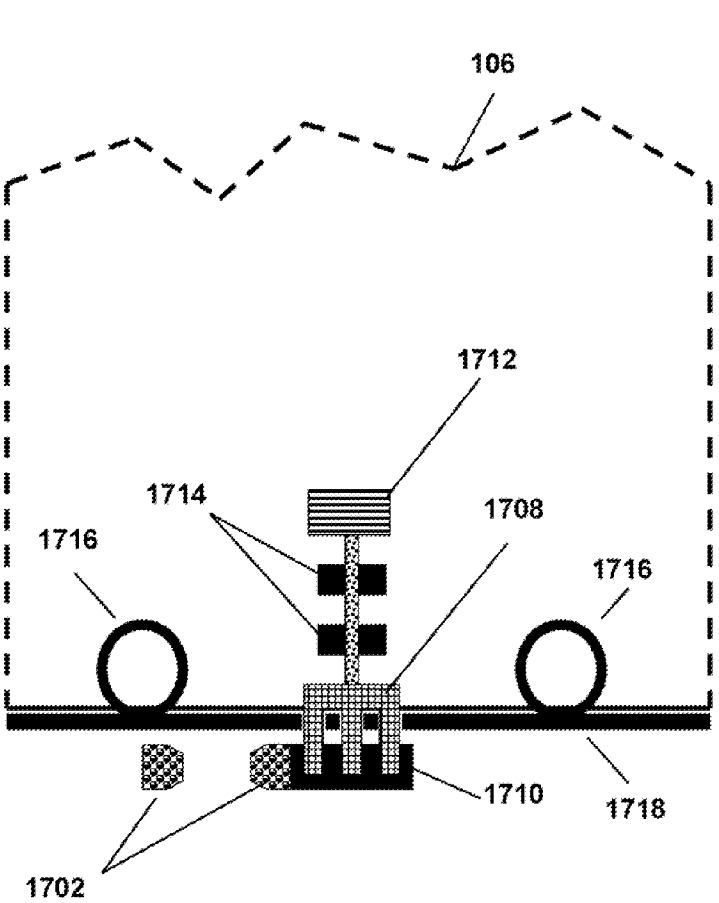
FIGS. 17A and 17B illustrate an embodiment of an anchor assembly in accordance with the present invention that descends from a door panel to engage a drive socket below in order to resist movement when a side impact or force is applied to the door panel.
Figure 17A:
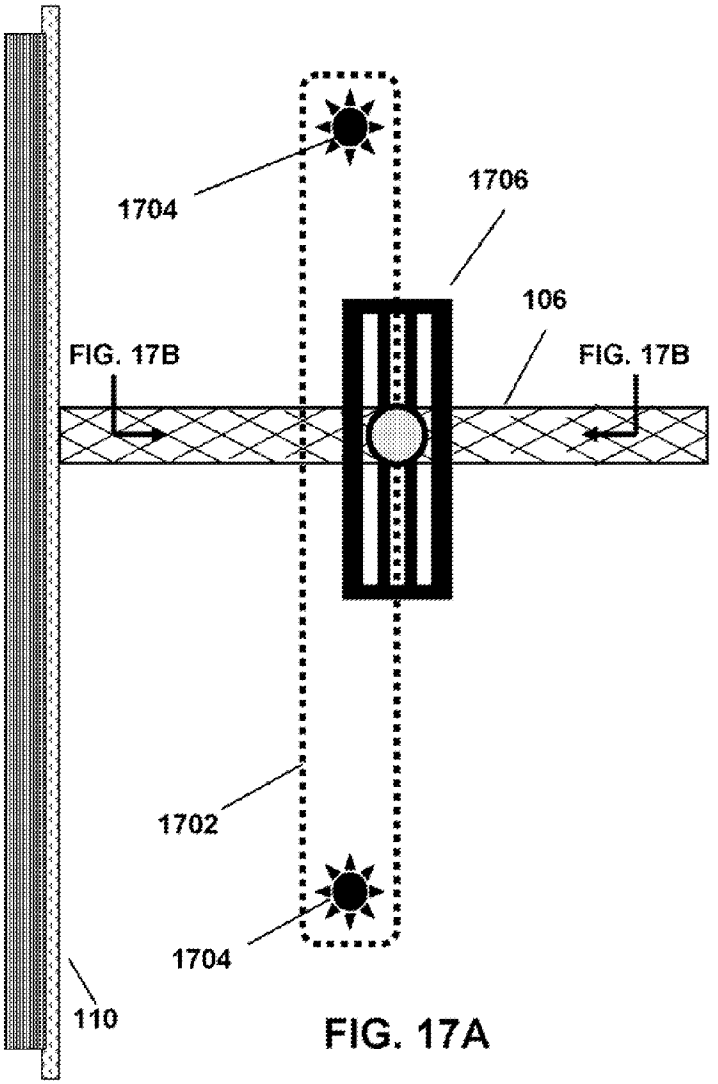

To ensure structural rigidity of a sliding door panel including an ability to withstand side impacts applied by an attacker, especially when it is positioned fully perpendicular to the sidewalls, the mechanism of FIGS. 17A and 17B may be added. According to FIG. 17A, a belt drive or chain drive mechanism 1702 or other equivalent mechanism for linearly driving is included under the floor panel 1718 of the portal per FIG. 17B. If a toothed belt or chain drive is utilized for 1702, then some form of sprocket 1704 may also be used to drive the belt or chain. One or more of the sprockets 1704 shown may apply drive, and the remainder may be idler sprockets. In the top view of FIG. 17A, a slotted grating 1706 has been placed into the floor panel of the portal such that forked anchor assembly 1708 of FIG. 17B may, at certain points in time, descend vertically through floor panel 1718 and engage with drive socket 1710 which is attached to toothed belt or chain 1702. Immediately upon door panel 106 becoming perpendicular to sidewall 110, fork 1708 would descend through floor panel 1718 and engage with drive socket/receptacle 1710. Subsequently as door panel 106 moves longitudinally in the direction parallel to sidewall 110, drive socket 1710 moves at the same rate as door panel 106 being driven by 1702 until the point where door panel 106 starts to swing open. At that point in time, drive fork 1708 ascends within door panel 106 above floor panel 1718 thus disengaging with drive socket 1710. Vertical motion of fork 1708 may be provided by number of mechanisms including for example some form of a solenoid drive or motor driven rack and pinion drive embodied in mechanism 1712 contained within door panel 106. A shaft connecting 1712 with drive fork 1708 may include bearings 1714. To support some of the weight of the door panel 106, coasters 1716 are shown as one example.

Figure 18:
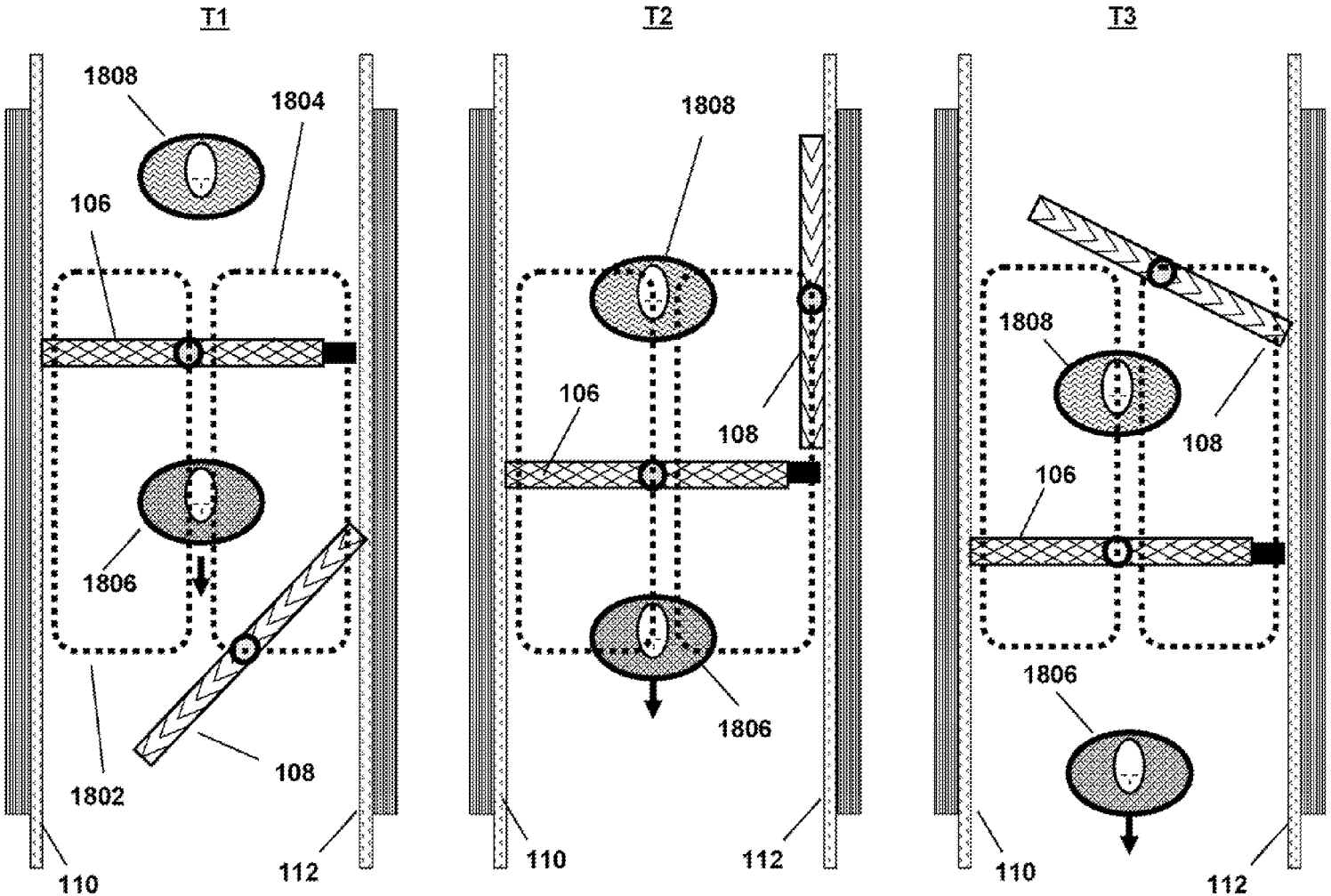
FIG. 18 is a top view showing different moments in time where embodiments of door panels in accordance with the present invention are driven at least in part from the bottom by a drive socket following a substantially rectangular path.

It may be advantageous to provide drive for moving door panels 106 and 108 from the bottom of those panels during their entire cycle of movement as the portal operates as shown in FIG. 18. This would supplement any drive which might be provided from the tops of the portal and would also serve to help anchor the moving door panels from the bottom in order to provide resistance to any side-impact which might be applied by a subject attempting to force their way through the portal. Three points in time during a sequence of operation are shown in FIG. 18. In time period T1 two drive paths are shown. Drive path 1802 provides drive for door panel 106 and drive path 1804 provides drive for door panel 108, in both cases driving the panels from the bottom in both lateral and longitudinal directions. Rotational movement of each door panel may be provided by separate mechanisms where examples are shown earlier in this specification. Note that rotational movement of a door panel can be imparted to the door panel from either the top or the bottom or both, and that a rotational drive mechanism including a motor can be positioned below a door panel, above a door panel, or alternately be contained within a door panel. In time period T1 of FIG. 18, subject 1806 is between the door panels and just beginning to exit while subject 1808 is just approaching. Time period T2 shows the next progression in a cycle of the door panels within the portal, and time period T3 shows yet another point in the progression where subject 1808 is now almost enclosed in a detection chamber between moving door panels 106 and 108. Notice that in all of time periods T1 through T3 the center of each door panel is positioned over one of drive paths 1802 and 1804.

Figure 19B:
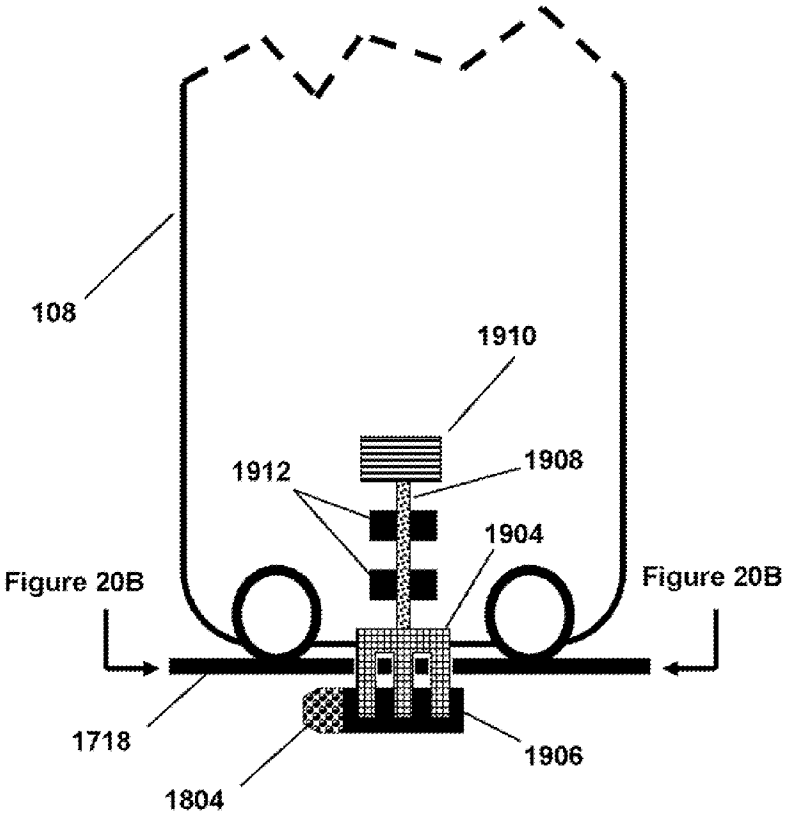
FIGS. 19A and 19B show additional detail for the embodiment of FIG. 18.
Figure 19A:
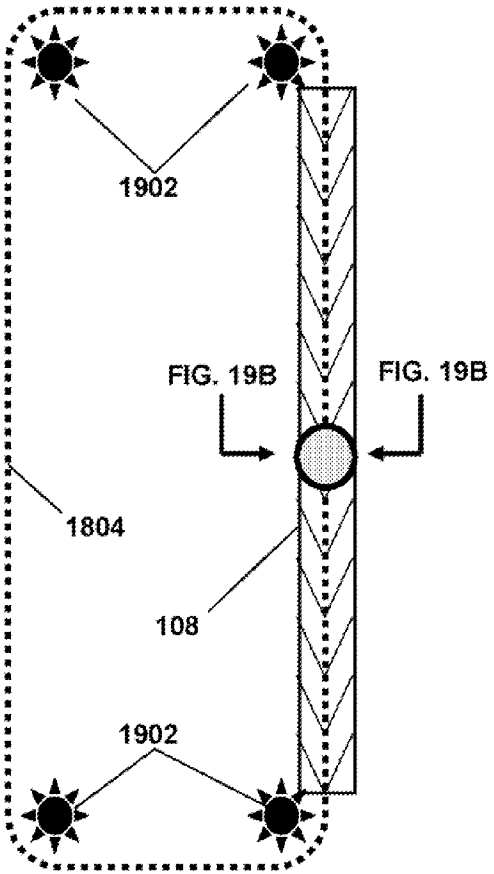

Drive path 1804 and door panel 108 are shown in FIG. 19A where sprockets 1902 are shown defining drive path 1804 which may be implemented with either a toothed belt, chain, or some other equivalent mechanism which defines the path. Cross-section of FIG. 19A is shown in FIG. 19B where a toothed belt implementing path 1804 is shown attached to a drive socket 1906, where both are located below floor panel 1718. Drive fork 1904 passes through slots in floor panel 1718 to engage with drive socket 1906. A shaft 1908 connects drive fork 1904 with an exemplary vertical drive mechanism 1910 through exemplary bearings 1912. In the embodiment of FIGS. 19A and 19B, drive fork 1904 would always be engaged with drive socket 1906 during normal operation, and would only be raised when door panel 108 is accessed for service.

Figure 20B:
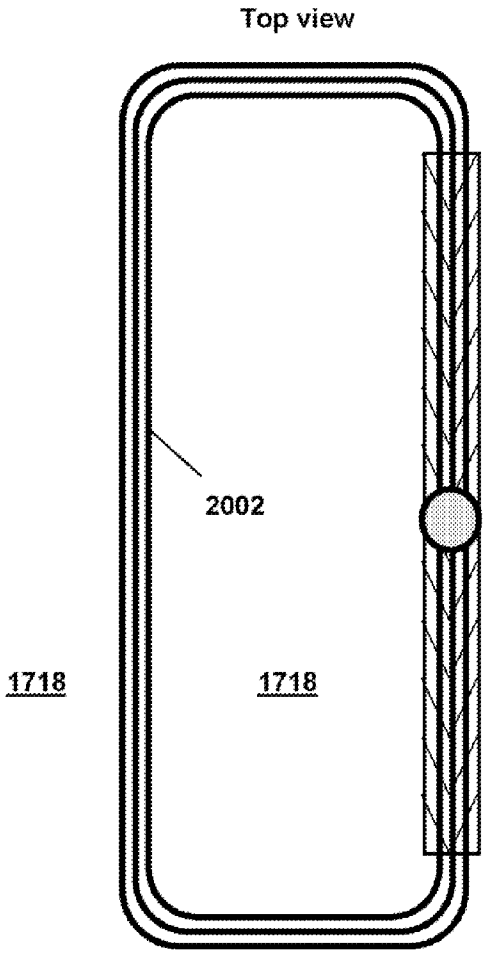
Figure 20A:
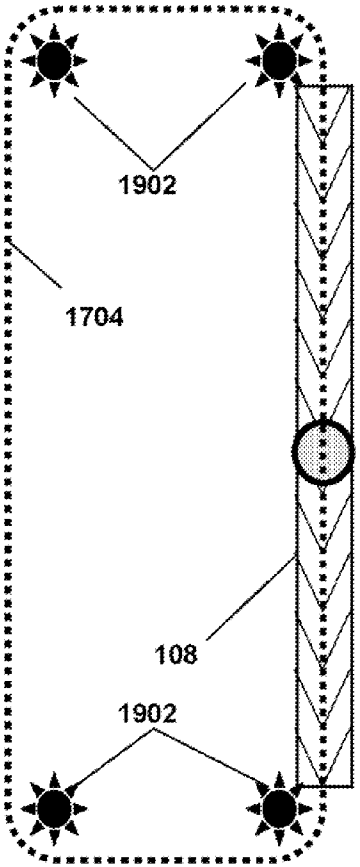
FIG. 20A is a top view of a door panel and an arrangement of sprockets and belt drive located below a floor panel for use with embodiments of the present invention.

A top view of the cross-section defined in FIG. 19A is shown in FIG. 20B. FIG. 20A repeats the contents of FIG. 19A for reference. FIG. 20B shows three slots 2002 in floor panel 1718 through which tined drive fork 1904 may pass in order to engage with drive socket 1906 located below floor panel 1718. Having a plurality of slots as opposed to one slot is advantageous since it allows each slots to be smaller. Smaller slots are advantageous since pedestrians walk on the slots.

Figure 21:
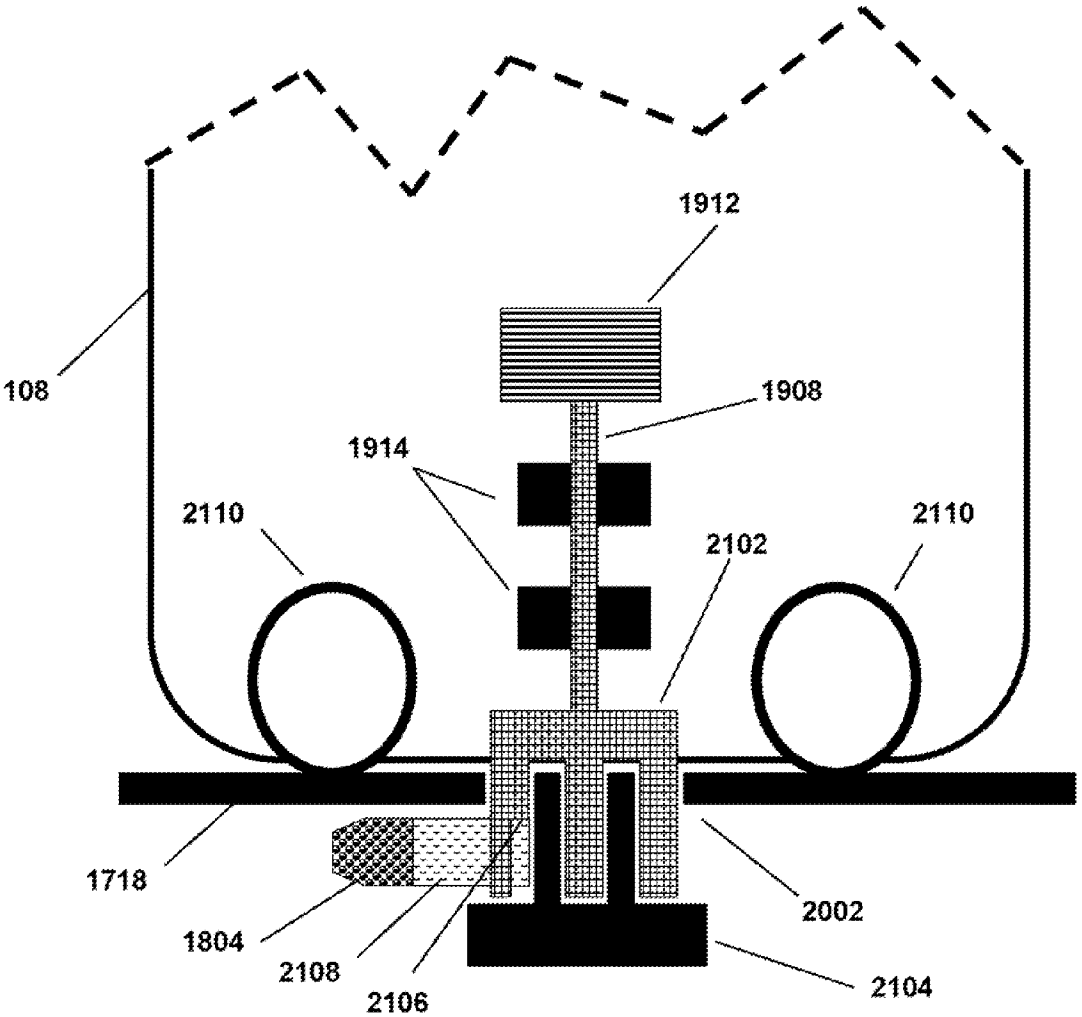
FIG. 21 is an enlarged view of the cross-section diagram of FIG. 19B, including a first alternate embodiment for the interface between the drive fork and drive socket.

A more detailed view at the cross-section defined in FIG. 19A is shown in FIG. 21. Per FIG. 21 drive fork 2102 passes through slots 2002 in floor panel 1718 to engage with drive socket 2108. Notice that drive fork 2102 has been notched or narrowed 2106 to allow drive fork 2106 to surround at least a portion of drive fork 2102 while still providing clearance with structure 2104 mounted below. Structure 2104 has forked structures protruding upwards that effectively define a portion of slots 2002. Notice that coasters 2110 have also been added within door panel 108.

Figure 22:
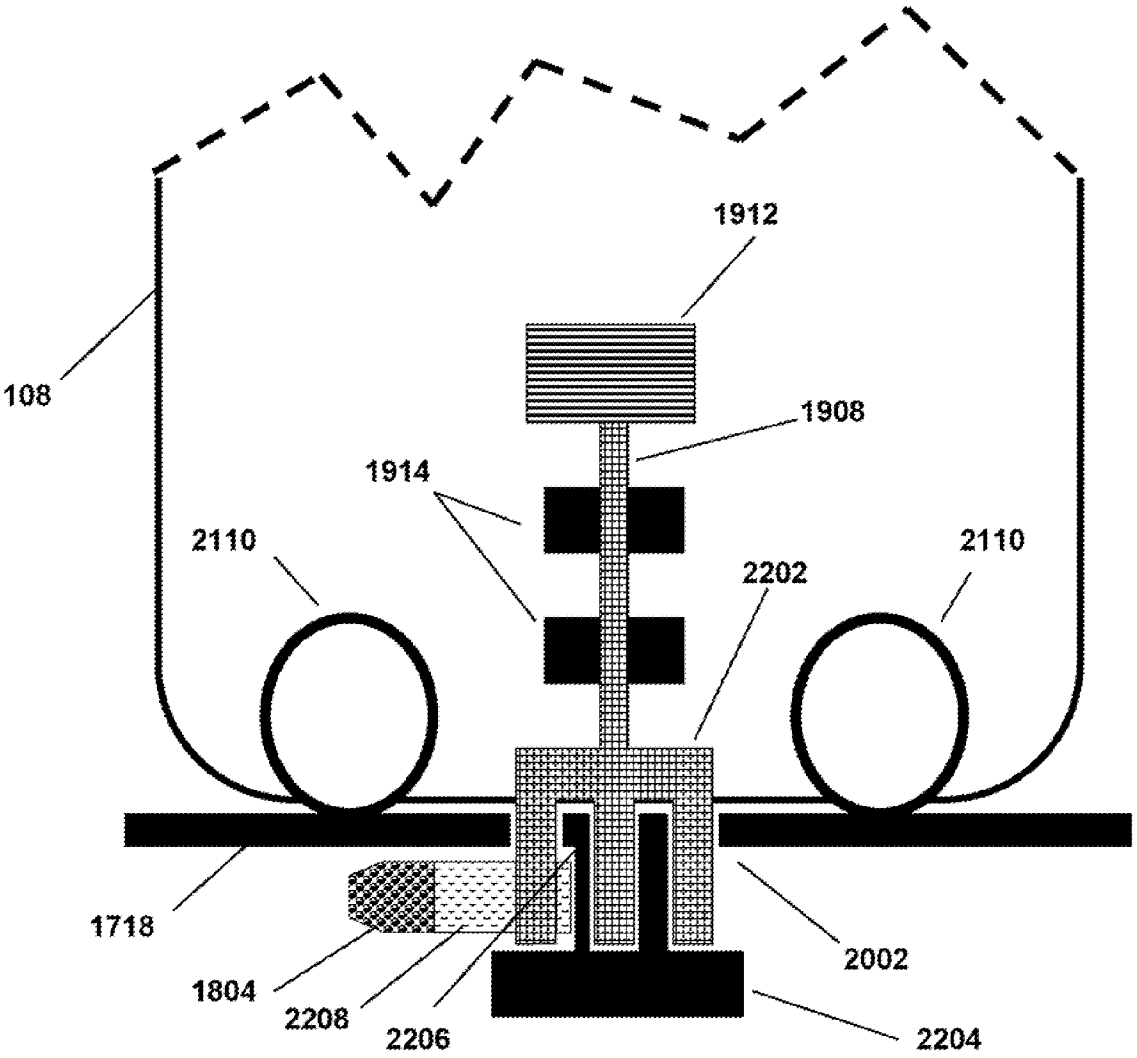
FIG. 22 is an enlarged view of the cross-section diagram of FIG. 19B, including a second alternate embodiment for the interface between the drive fork and drive socket.

An alternative embodiment to the mechanism shown in FIG. 21 is shown in FIG. 22. Here, drive fork 2202 passes through slots 2002 in floor panel 1718 and engages with drive socket 2208. Slots in floor panel 1718 are defined in part by structure 2204 mounted below. Note in particular that one fork of structure 2204 has been partially narrowed 2206 to provide clearance for drive socket 2208 such that drive fork 2202 need not be notched as shown in FIG. 21. Alternately some narrowing of structure 2204 might be utilized in combination with some degree of notching drive fork 2202, essentially combining the embodiments of FIGS. 21 and 22.

While earlier embodiments in this specification show moving door panels driven in lateral and longitudinal directions from the top by moving arms or sliding roof panels, note that a drive path mechanism similar to that shown in the embodiments of FIGS. 18-22 could also be utilized for driving a door panel in lateral and longitudinal directions from above. Such mechanisms mounted above the door panels could also be used in conjunction with drive mechanisms driving the door panels from below, or alternately could be used above as the sole drive mechanisms for lateral and longitudinal movement of the door panels.

Figure 23:
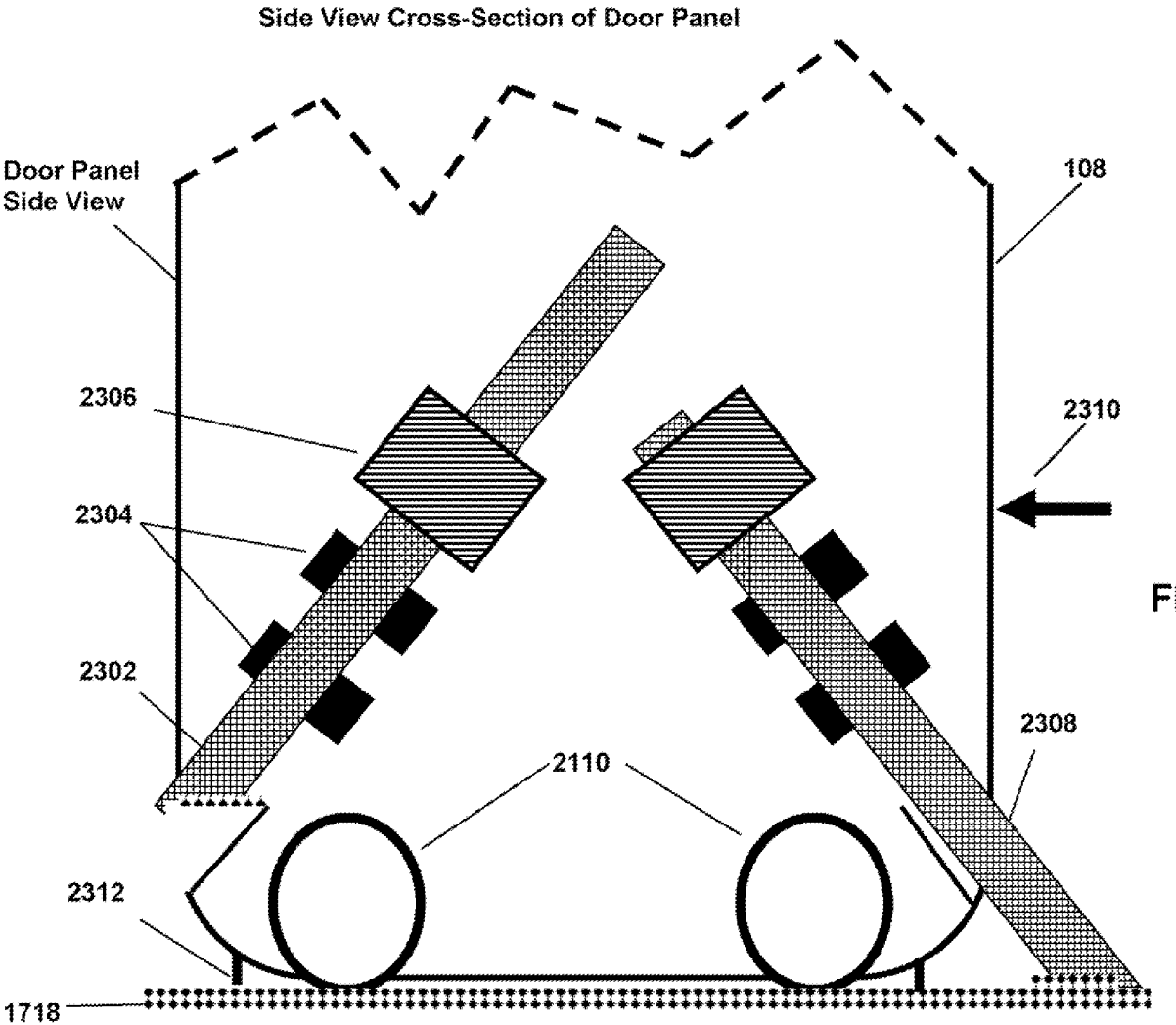
FIG. 23 is an exemplary cross-section of a door panel for use with embodiments of the present invention where brake assemblies have been included, and wherein one deployed brake assembly is shown having descended in response to a side impact or pressure on a door panel.

An alternate embodiment for preventing undesired movement of a door panel resulting from an impact or side pressure on the door panel is shown in FIG. 23. Here, one or more anti-impact brake mechanisms 2302 may be included in the lower portion of a door panel. Brake mechanisms 2302 may be oriented vertically or at an angle as shown in FIG. 23, and may be supported by bearings 2304 and include some form of drive mechanism 2306, which could for example a solenoid or motor drive. When a force 2310 is applied to the side of a door panel, such a force or impact is sensed by sensors incorporated either in the door panel or in structures connecting with the door panel, and subsequently an anti-impact brake is deployed 2308 as shown in response to the impact or force. Note that when a gap of any consequential size exists between the lower surface of door panel 108 and floor 1718, skirts 2312 may be included to assist in sealing that gap. The use of optional coasters 2110 to assist in supporting the weight of door panel 108 may cause such a gap to exist, or a gap may exist when door panels are fully supported from above.

Figures 24A, 24B:
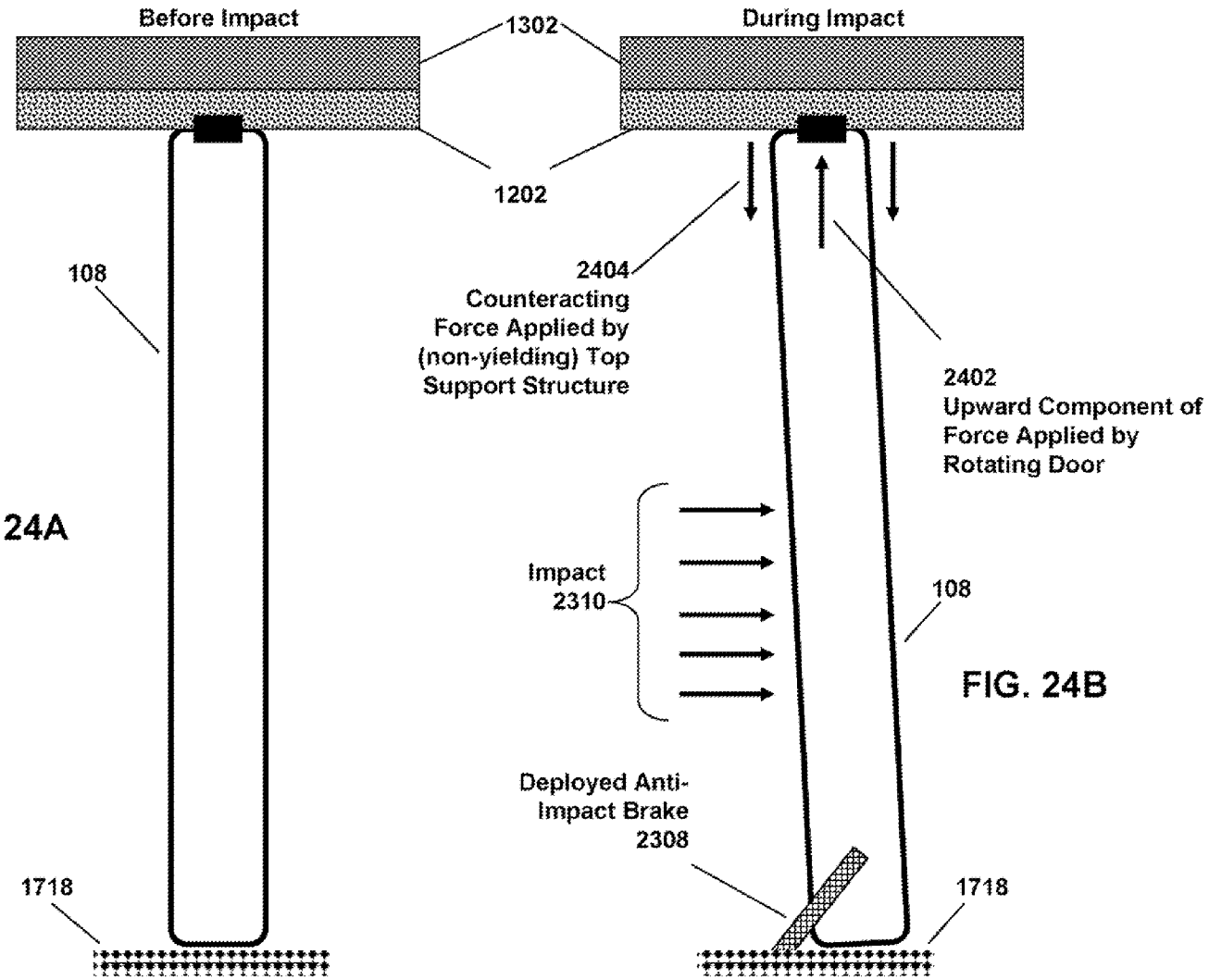
FIGS. 24A and 24B show the relative positioning of a door panel both before (FIG. 24A) and after (FIG. 24B) a side impact is applied to the door panel.

FIGS. 24A and 24B show the relative positioning of a door panel both before (FIG. 24A) and after (FIG. 24B) a side impact is applied to the door panel. Note that per FIG. 24B, as a door panel begins to rotate as a result of an impact, its effective height changes as the diagonal measurement of the door becomes a greater percentage of its height. As a result, upward force 2402 is applied by the door to sliding roof panel 1202 which in turn is supported by top cover 1302. A counteracting force 2404 is applied by these overhead structures in a downward vertical direction, and to the extent the combination of structures 1202 and 1302 is rigid, acts to assist deployed impact brake 2308 in preventing further side movement of the door panel.

Figure 25:
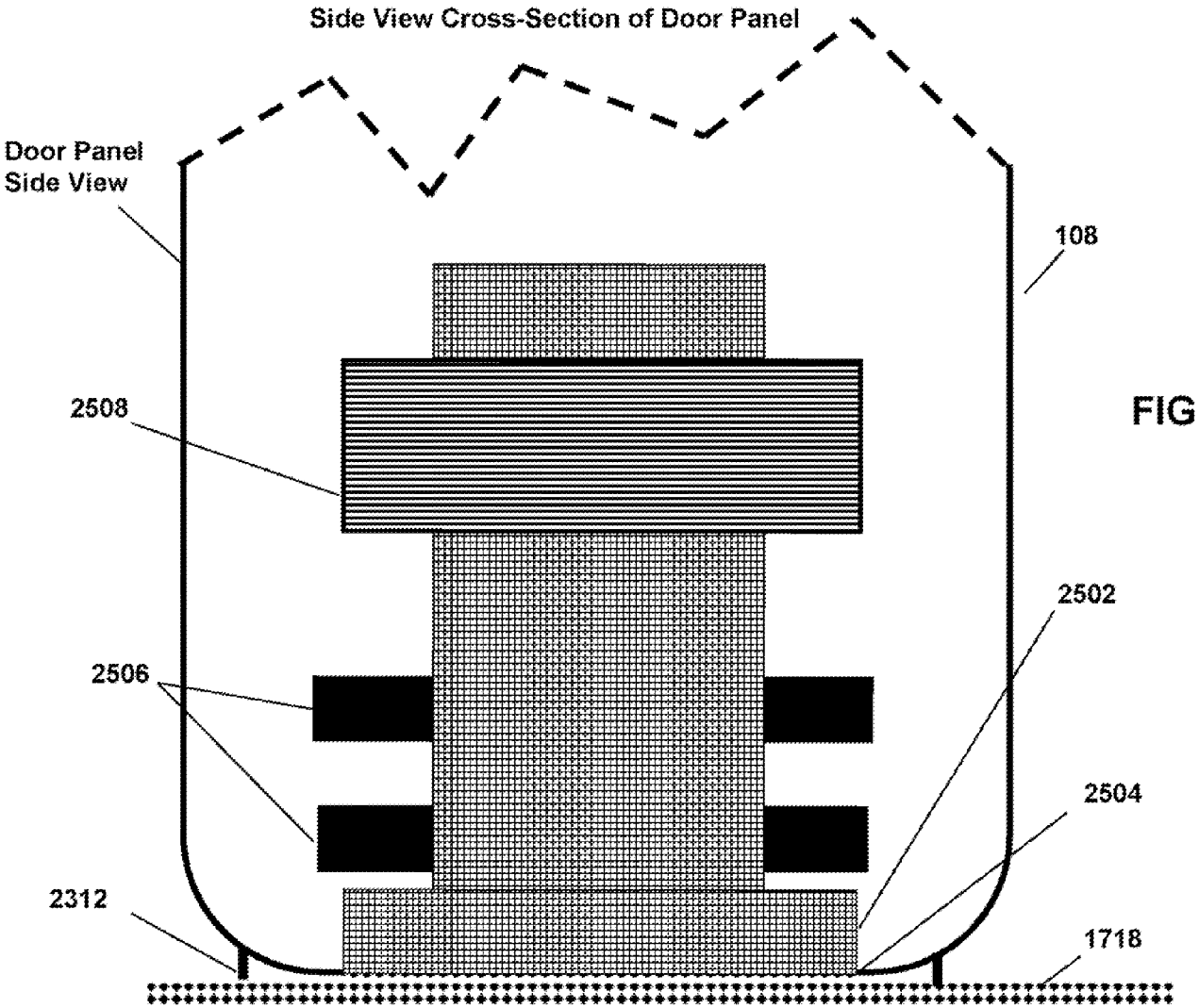
FIG. 25 is an enlarged cross-section of a door panel for use with embodiments of the present invention including a vertically-oriented brake assembly for mitigating effects of a side impact by deploying in response to the impact and engaging with the floor.

FIG. 25 is an enlarged cross-section of a door panel including a brake assembly for mitigating effects of a side impact, whereby a brake deploys in response to the impact and engages with the floor. The brake is driven by drive assembly 2508 and is for example supported by bearings 2506. On the lower surface of anti-impact brake 2502 is a high grip surface 2504 suitable for engaging with material covering floor panel 1718. High grip surface 2504 may also be slightly radiused in order to provide a maximum gripping capability even when door panel 108 has been already rotated to some extent as a result of a side impact.

Figures 26A, 26B:
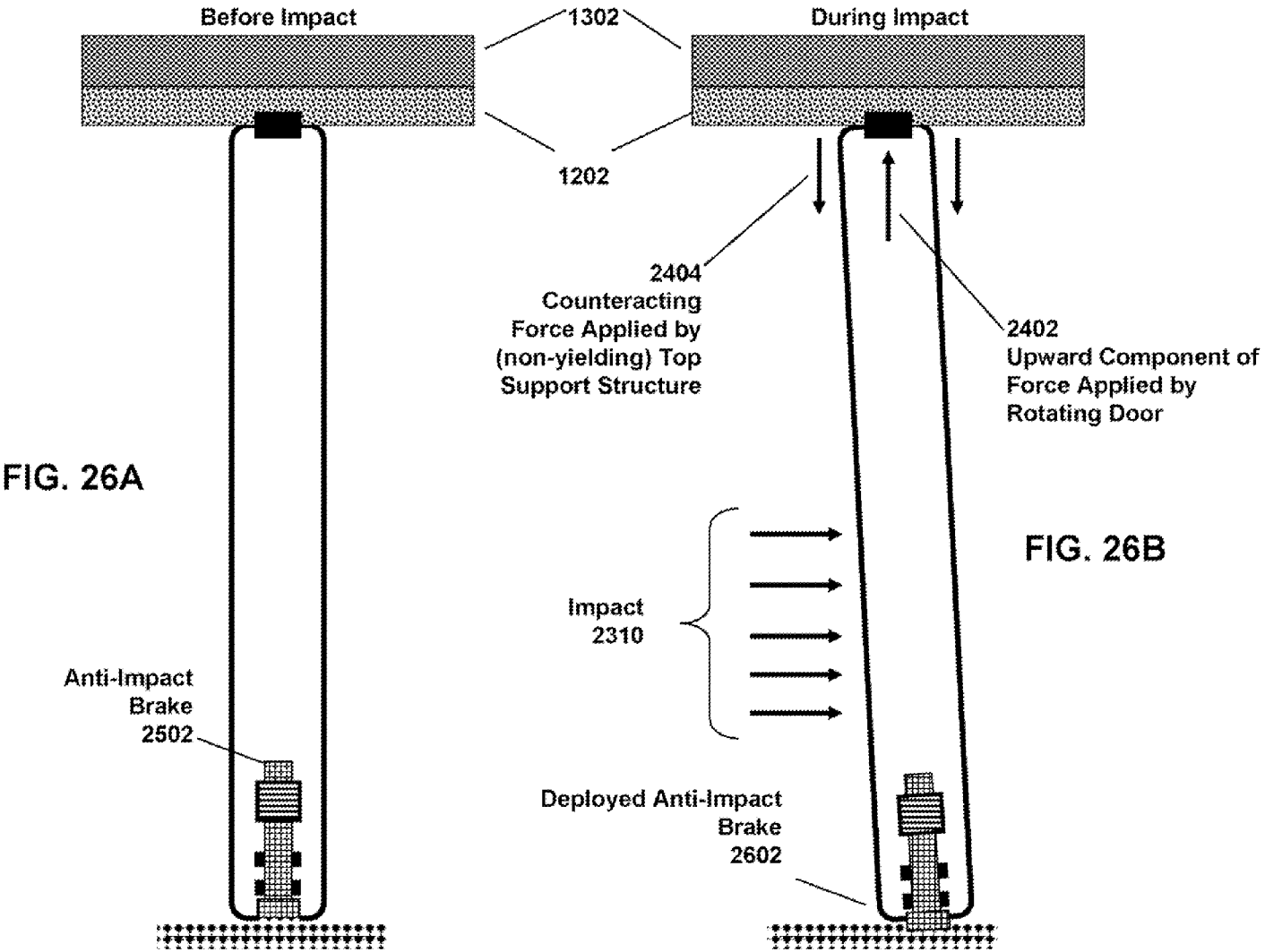
FIGS. 26A and 26B show the relative positioning of a door panel both before (FIG. 26A) and after (FIG. 26B) a side impact is applied to the door panel, and where a vertically-oriented anti-impact brake has been deployed as shown in FIG. 26B.

FIGS. 26A and 26B shows the relative positioning of a door panel both before (FIG. 26A) and after (FIG. 26B) a side impact is applied to the door panel, and where a vertically oriented anti-impact break per FIG. 25 has been deployed 2602 as shown in FIG. 26B.

Figure 27A:
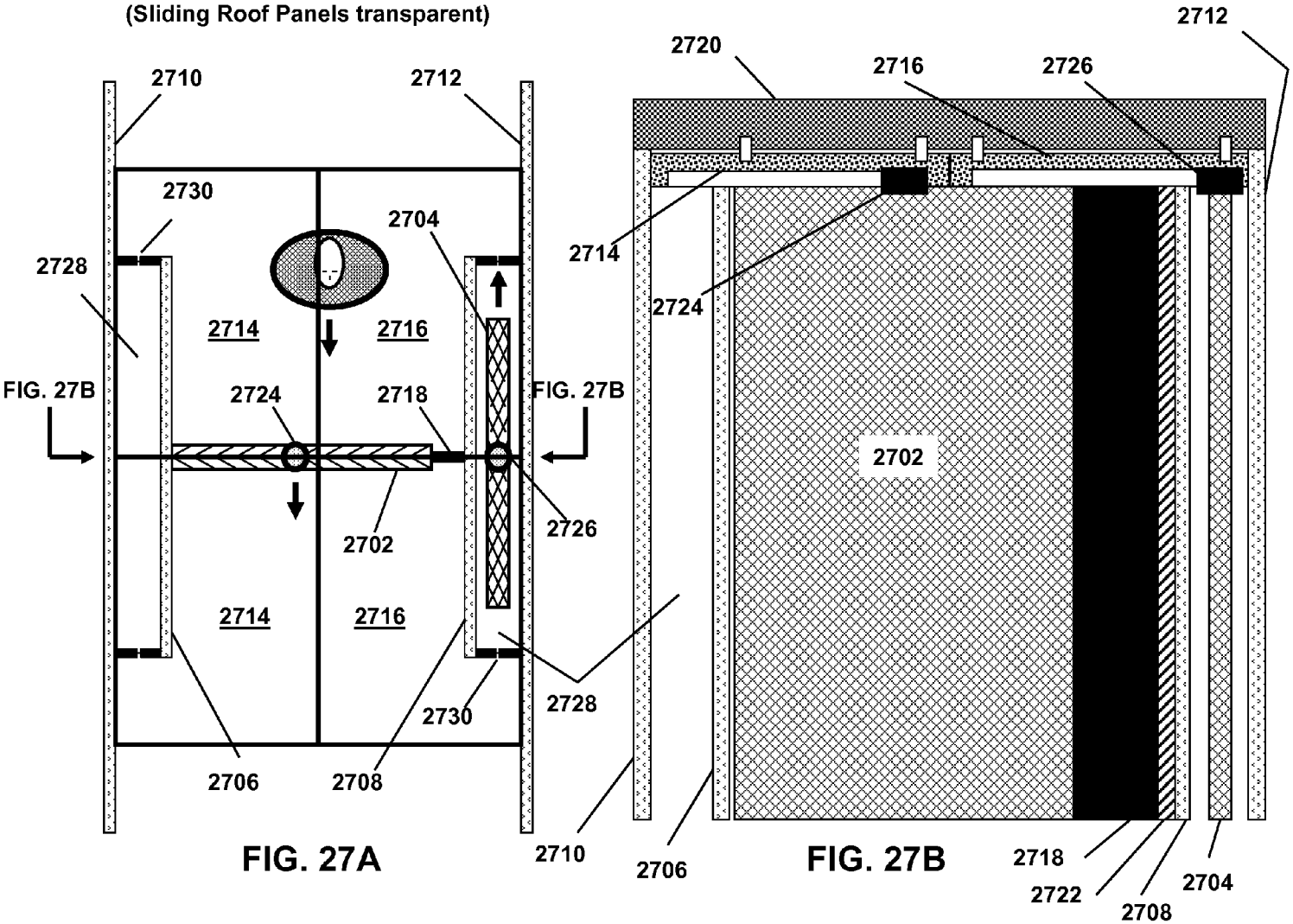
FIG. 27A is a top view of an entryway where sealed passageways have been added on either side of the sidewalls that define a pedestrian's path through the entryway. Each passageway allows a return path for a moving door panel as it rotates into a position parallel to a sidewall and moves in a direction opposite the current pedestrian direction of travel.

FIG. 27A is a top view of an entryway where sealed passageways 2728 have been added on either side of the sidewalls that define a pedestrian's path through the entryway. These passageways allow a return path for a moving door panel as it rotates into a position parallel to a sidewall and moves in a direction opposite the current pedestrian direction of travel. Door panels 2702 and 2704 move in a similar manner to moving door panels shown in previous figures, however when a door panel such as 2704 is parallel to entryway sidewall 2708 and is moving in a direction opposite that of a pedestrian currently within the entryway, door panel 2704 now passes through a sealed passageway 2728 formed by entryway sidewall 2708 and outer wall 2712. A similar passageway is formed on the opposite side of the entryway between sidewall 2706 and outer wall 2710. Note that rotational drive mechanisms 2724 and 2726 are shown positioned in alignment with the central axis of each respective door panel, and as such a gap is formed between the door panel and an opposite sidewall when the door panel is perpendicular to the sidewall. So for example, when door panel 2702 is perpendicular to the sidewalls as shown in FIG. 27A, a gap filling mechanism such as telescoping extension 2718 is required to fill the gap between door panel 2702 and sidewall 2708. The exemplary embodiment shown in FIGS. 27A and 27B utilizes sliding roof panels 2714 and 2716 to drive and support moving door panels 2702 and 2704 respectively, however other mechanisms described herein may instead be used to drive the moving door panels. Note that sliding roof panels 2714 and 2716 extend laterally beyond sidewalls 2706 and 2708 to reach outer walls 2710 and 2712, thus enabling lateral drive mechanisms for door panels 2702 and 2704 to position a door panel within a sealable passageway 2728 for the return path of a door panel such as that shown for door panel 2704 in FIG. 27A. Note that each end of a passageway 2728 is sealable by a door mechanism 2730 that opens to allow entry or exit of a moving door panel and is otherwise sealed. Door mechanism 2730 may comprise single or multiple structures and may be hinged at one side, hinged at both sides, or alternately comprise some form of sliding structure or other door structure is known in the art.

FIG. 27B shows a top view cross-section of the embodiment of FIG. 27A including telescoping extension 2718 and a seal 2722 that comprises the outer edge of telescoping extension 2718. Note in the cross-section shown in FIG. 27B that top cover 2720 extends beyond sidewalls 2706 and 2708 to outer walls 2710 and 2712.

Figures 28A, 28B:
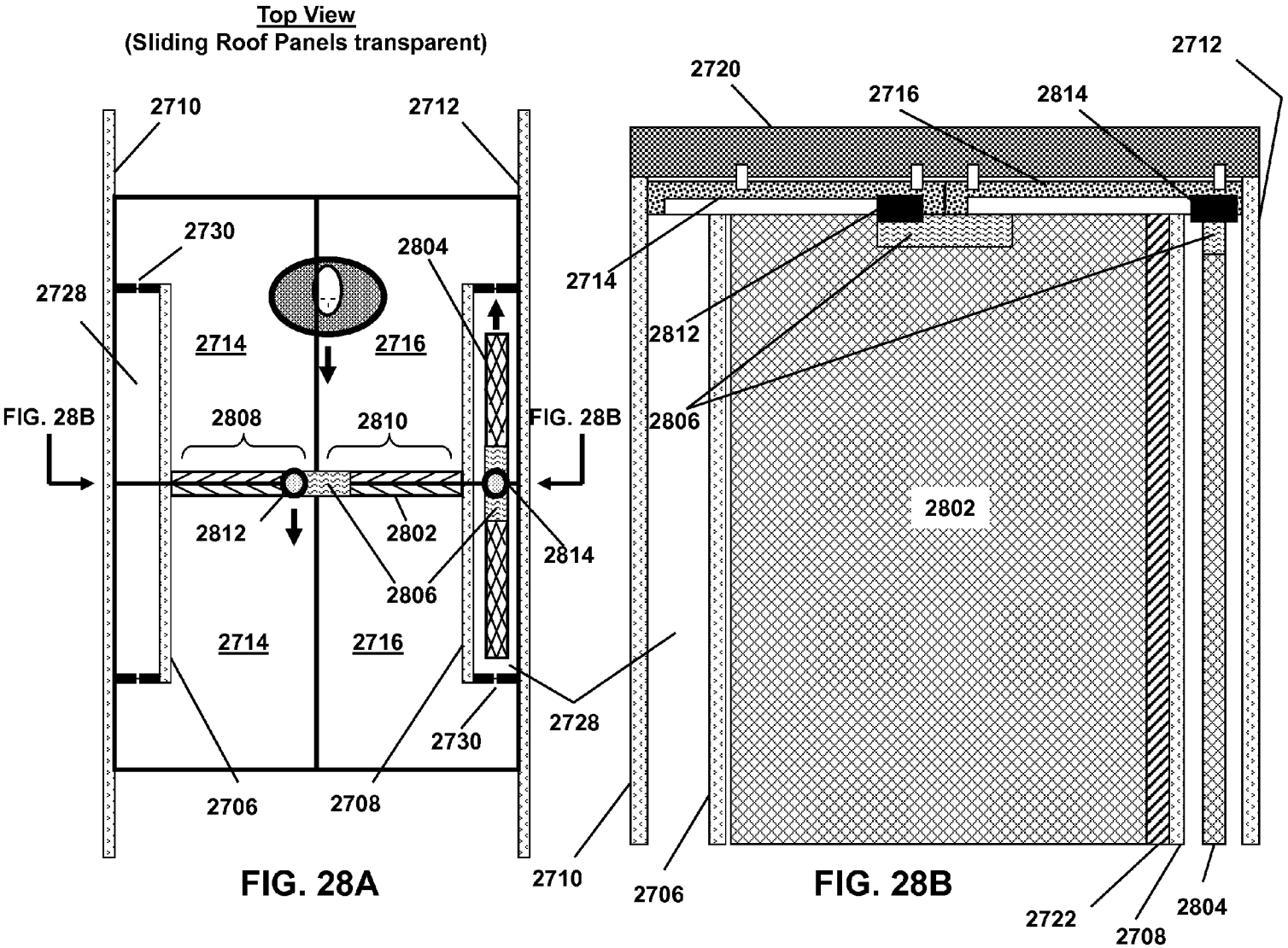
FIG. 28A is a top view of an entryway where sealed passageways have been added on either side of the sidewalls that define a pedestrian's path through the entryway. These passageways allow a return path for a moving door panel as it rotates into a position parallel to a sidewall and moves in a direction opposite the current pedestrian direction of travel.
FIG. 28B is a cross-section side view of the embodiment of FIG. 28A. A slide mechanism is included that enables the rotational drive mechanism at the top of a door panel to change its position relative to the central axis of the door panel. Thus a telescoping extension is not required to fill a gap between a door panel and an opposite sidewall when the door panel is perpendicular to the sidewall. Per FIG. 28B, there is no gap.

FIG. 28A shows a top view of an entryway where sealed passageways 2728 have been added on either side of the sidewalls that define a pedestrian's path through the entryway. These passageways allow a return path for a moving door panel as it rotates into a position parallel to a sidewall and moves in a direction opposite the current pedestrian direction of travel. Door panels 2802 and 2804 move in a similar manner to moving door panels shown in previous figures, however when a door panel such as 2804 is parallel to entryway sidewall 2708 and is moving in a direction opposite that of a pedestrian currently within the entryway, door panel 2804 now passes through a sealed passageway 2728 formed by entryway sidewall 2708 and outer wall 2712. A similar passageway is formed on the opposite side of the entryway between sidewall 2706 and outer wall 2710.

Note that moving door panels 2802 and 2804 each include slider mechanism 2806 that enables the rotational drive mechanism at the top of a door panel to change its position relative to the central axis of the door panel. Thus, a telescoping extension is not required to fill a gap between a door panel and an opposite sidewall when the door panel is perpendicular to the sidewall as shown in FIG. 28B. Per FIG. 28B, there is no gap. In FIG. 28A, rotational drive mechanism 2812 is shown positioned at the far left of slider mechanism 2806 and is therefore no longer aligned with the central axis of door panel 2802, enabling portion 2810 of door panel 2802 to reach the opposite sidewall 2708. Thus, a telescoping extension such as 2718 is not required. During the time that moving door panel such 2804 is passing through a sealed passageway 2728, drive mechanism 2814 is repositioned within slider mechanism 2806 to move to the opposite side of door panel 2804. Note that on the next sequential cycle of the moving door panels, assuming the next pedestrian passes in the same direction as that shown in FIG. 28A, portion 2808 of door panel 2802 will be positioned such that it reaches sidewall 2708. Note that any re-positioning of a door panel rotational drive mechanism such as 2812 or 2814 can be done while passing through a sealed passageway. Thus, it is possible that a mechanism can be provided within each sealed passageway for re-positioning such drive mechanisms within their respective slider mechanisms 2806, and therefore no electromechanical drive mechanism for this specific purpose need be provided within the moving door panels themselves.

The exemplary embodiment shown in FIGS. 28A and 28B utilizes sliding roof panels 2714 and 2716 to drive and support moving door panels 2802 and 2804 respectively, however other mechanisms described herein may instead be used to drive the moving door panels. Note that sliding roof panels 2714 and 2716 extend laterally beyond sidewalls 2706 and 2708 to reach outer walls 2710 and 2712, thus enabling lateral drive mechanisms for door panels 2802 and 2804 to position a door panel within a sealable passageway 2728 for the return path of a door panel such as that shown for door panel 2804 in FIG. 28A.

FIG. 28B shows a top view cross-section of the embodiment of FIG. 28A including a seal 2722 that comprises the outer edge of moving door panel 2802. Note in the cross-section shown in FIG. 28B that top cover 2720 extends beyond sidewalls 2706 and 2708 to outer walls 2710 and 2712. Also note in FIG. 28B the position of rotational drive mechanism 2812 relative to slider mechanism 2806 thus enabling door panel 2802 to essentially block passage through the entryway without the need for a telescoping extension.

The various embodiments described throughout this specification also include the software and object code used to control the access control device according to various embodiments of this invention. These embodiments include a computer program product which is a storage medium (media) having instructions stored thereon/in, which can be used to program a general purpose or specialized computing processor(s)/device(s) to perform any of the features presented herein. As a non-limiting illustration, the instructions stored on the computer readable storage medium can cause a processor to rotate and move the panels of the security door in a particular sequence/manner. Similarly, the instructions can cause the processor to start, stop and resume the rotation of the door according to signals received from a set of sensors embedded in the security door. Additionally, the instructions can cause the processor to reverse the sequence of movement of the door panels after a suspected threat is detected such that the subject is compelled to back out of the access control device, or optionally be restrained within the access control device.

The storage medium can include, but is not limited to, one or more of the following: any type of physical media including floppy disks, optical discs, DVDs, CD-ROMs, microdrives, magneto-optical disks, holographic storage, ROMs, RAMs, PRAMS, EPROMs, EEPROMs, DRAMs, VRAMs, flash memory devices, magnetic or optical cards, nanosystems (including molecular memory ICs); paper or paper-based media; and any type of media or device suitable for storing instructions and/or information.

Stored on one or more of the computer readable medium (media), the present disclosure includes software for controlling both the hardware of general purpose/specialized computer(s) and/or processor(s), and for enabling the computer(s) and/or processor(s) to interact with a human user or other mechanism utilizing the results of the present invention. Such software may include, but is not limited to, device drivers, operating systems, execution environments/containers, user interfaces and applications.

The foregoing description of the preferred embodiments of the present invention has been provided for purposes of illustration and description. It is not intended to be exhaustive or to limit the invention to the precise forms disclosed. Many modifications and variations can be apparent to the practitioner skilled in the art. Embodiments were chosen and described in order to best explain the principles of the invention and its practical application, thereby enabling others skilled in the relevant art to understand the invention. It is intended that the scope of the invention be defined by the following claims and their equivalents.

What is claimed is:

1. A portal apparatus for securely controlling passage, said apparatus comprising:

a passageway including at least two moveable and rotatable door panels operating in conjunction with at least two sidewalls including at least one linear sidewall;

wherein each of said at least two door panels rotates to a position perpendicular to said at least one linear sidewall and a position parallel to said at least one linear sidewall;

wherein each of said at least two door panels moves in a first longitudinal direction that is parallel to said at least one linear sidewall;

wherein each of said two door panels moves in a second longitudinal direction that is parallel to said at least one linear sidewall while simultaneously being rotatably fixed in the position parallel to said at least one linear sidewall, wherein the second longitudinal direction is substantially opposite the first longitudinal direction; and wherein for a sequence of subjects passing through the portal apparatus in a first direction, a first side of a specific one of said at least two moveable and rotatable door panels will face a first subject and a second side of the specific one of said at least two moveable and rotatable door panels will face a subsequent subject.

2. The portal apparatus of claim 1, further comprising programming for operation supporting bi-directional passage by successive subjects, the programming causing the portal apparatus to behave according to at least the steps of:

starting a bi-directional sequence of passage with a first of the at least two door panels oriented in a neutral position substantially longitudinally centered in the portal apparatus and also positioned substantially perpendicular to the at least one linear sidewall; and when approached by a first subject moving in a first longitudinal direction, moving the first of the at least two door panels in the first longitudinal direction, while simultaneously moving a second of the at least two door panels initially in a second longitudinal direction opposite the first, followed by rotating and moving the second of the at least two door panels in the first longitudinal direction such that after the first subject has passed through the portal apparatus the second of the at least two door panels has assumed the neutral position substantially longitudinally centered in the portal apparatus and also positioned substantially perpendicular to the at least one linear sidewall.

3. The portal apparatus of claim 2, wherein the programming for operation supporting bi-directional passage further causes the portal apparatus to behave according to at least the steps of:

starting with the second of the at least two door panels positioned in the neutral position substantially longitudinally centered in the portal apparatus and also positioned substantially perpendicular to the at least one linear sidewall, when approached by a second and successive subject moving in the second longitudinal direction opposite the first longitudinal direction, moving the second of the at least two door panels in the second longitudinal direction, while simultaneously moving the first of the at least two door panels initially in the first longitudinal direction.

4. The portal apparatus of claim 2, wherein the first of the at least two door panels rotates to the position parallel to the at least one linear sidewall to allow the first subject to exit the portal apparatus.

5. The portal apparatus of claim 3, wherein the second of the at least two door panels rotates to the position parallel to the at least one linear sidewall to allow the second subject to exit the portal apparatus.

6. The portal apparatus of claim 1, wherein except for allowing passage of a subject in the passageway as controlled by the door panels, the passageway is sealed such that weapon passing from a first perpetrator to a second perpetrator through the portal apparatus is not possible.

7. A portal apparatus for securely controlling passage, said apparatus comprising:

a passageway including at least two moveable and rotatable door panels operating in conjunction with at least two sidewalls including at least one linear sidewall;

wherein each of said at least two door panels rotates to a position perpendicular to said at least one linear sidewall and a position parallel to said at least one linear sidewall;

wherein each of said at least two door panels moves in a first longitudinal direction that is parallel to said at least one linear sidewall, and a second longitudinal direction that is parallel to said at least one linear sidewall, wherein the second longitudinal direction is substantially opposite the first longitudinal direction; and wherein for a sequence of subjects passing through the portal apparatus in a first direction, a first side of a specific one of said at least two moveable and rotatable door panels will face a first subject and a second side of the specific one of said at least two moveable and rotatable door panels will face a subsequent subject.

8. The portal apparatus of claim 7, further comprising programming for operation supporting bi-directional passage by successive subjects, the programming causing the portal apparatus to behave according to at least the steps of:

starting a bi-directional sequence of passage with a first of the at least two door panels oriented in a neutral position substantially longitudinally centered in the portal apparatus and also positioned substantially perpendicular to the at least one linear sidewall, and a second of the at least two door panels positioned parallel to the at least one linear sidewall; and when approached by a first subject moving in a first longitudinal direction, moving the first of the at least two door panels in the first longitudinal direction, while simultaneously moving the second of the at least two door panels to the neutral position substantially longitudinally centered in the portal apparatus and also positioned substantially perpendicular to the at least one linear sidewall.

9. The portal apparatus of claim 8, wherein the programming for operation supporting bi-directional passage further causes the portal apparatus to behave according to at least the steps of:

starting with the second of the at least two door panels positioned in the neutral position substantially longitudinally centered in the portal apparatus and also positioned substantially perpendicular to the at least one linear sidewall, when approached by a second and successive subject moving in the second longitudinal direction opposite the first longitudinal direction, moving the second of the at least two door panels in the second longitudinal direction while returning the first of the at least two door panels to the neutral position substantially longitudinally centered in the portal apparatus and also positioned substantially perpendicular to the at least one linear sidewall.

10. The portal apparatus of claim 8, wherein the first of the at least two door panels rotates to the position parallel to the at least one linear sidewall to allow the first subject to exit the portal apparatus.

11. The portal apparatus of claim 9, wherein the second of the at least two door panels rotates to the position parallel to the at least one linear sidewall to allow the second subject to exit the portal apparatus.

12. The portal apparatus of claim 7, wherein except for allowing passage of a subject in the passageway as controlled by the door panels, the passageway is sealed such that weapon passing from a first perpetrator to a second perpetrator through the portal apparatus is not possible.

13. A portal apparatus for securely controlling passage, said apparatus comprising:

a passageway including at least two moveable and rotatable door panels operating in conjunction with at least two sidewalls including at least one linear sidewall;

wherein each of said at least two door panels rotates to a position perpendicular to said at least one linear sidewall and a position parallel to said at least one linear sidewall;

wherein each of said at least two door panels rotates in a first longitudinal direction to a position where said each of said at least two door panels is positioned perpendicular to said at least one linear sidewall;

wherein each of said two door panels moves in a second longitudinal direction that is parallel to said at least one linear sidewall while simultaneously being fixed in the position parallel to said at least one linear sidewall, wherein the second longitudinal direction is substantially opposite the first longitudinal direction; and wherein for a sequence of subjects passing through the portal apparatus in a first direction, a first side of a specific one of said at least two moveable and rotatable door panels will face a first subject and a second side of the specific one of said at least two moveable and rotatable door panels will face a subsequent subject.

14. The portal apparatus of claim 13, further comprising programming for operation supporting bi-directional passage by successive subjects, the programming causing the portal apparatus to behave according to at least the steps of:

starting a bi-directional sequence of passage with a first of the at least two door panels oriented in a neutral position substantially longitudinally centered in the portal apparatus and also positioned substantially perpendicular to the at least one linear sidewall, and a second of the at least two door panels positioned parallel to the at least one linear sidewall; and when approached by a first subject moving in a first longitudinal direction, moving the first of the at least two door panels in the first longitudinal direction, while simultaneously moving the second of the at least two door panels to the neutral position substantially longitudinally centered in the portal apparatus and also positioned substantially perpendicular to the at least one linear sidewall.

15. The portal apparatus of claim 14, wherein the programming for operation supporting bi-directional passage further causes the portal apparatus to behave according to at least the steps of:

starting with the second of the at least two door panels positioned in the neutral position substantially longitudinally centered in the portal apparatus and also positioned substantially perpendicular to the at least one linear sidewall, when approached by a second and successive subject moving in the second longitudinal direction opposite the first longitudinal direction, moving the second of the at least two door panels in the second longitudinal direction while returning the first of the at least two door panels to the neutral position substantially longitudinally centered in the portal apparatus and also positioned substantially perpendicular to the at least one linear sidewall.

16. The portal apparatus of claim 14, wherein the first of the at least two door panels rotates to the position parallel to the at least one linear sidewall to allow the first subject to exit the portal apparatus.

17. The portal apparatus of claim 15, wherein the second of the at least two door panels rotates to the position parallel to the at least one linear sidewall to allow the second subject to exit the portal apparatus.

18. The portal apparatus of claim 13, wherein except for allowing passage of a subject in the passageway as controlled by the door panels, the passageway is sealed such that weapon passing from a first perpetrator to a second perpetrator through the portal apparatus is not possible.

19. A portal apparatus for securely controlling passage, said apparatus comprising:

a passageway including at least two moveable and rotatable door panels operating in conjunction with at least two sidewalls including at least one linear sidewall;

wherein each of said at least two door panels rotates to a position perpendicular to said at least one linear sidewall and a position parallel to said at least one linear sidewall;

wherein at one point in time during an operation of the portal apparatus a first of the at least two moveable and rotatable door panels moves in a first longitudinal direction that is parallel to said at least one linear sidewall while being oriented parallel to said at least one linear sidewall, while simultaneously a subject moves through the passageway in a second longitudinal direction that is opposite the first longitudinal direction; and wherein for a sequence of subjects passing through the portal apparatus in a first direction, a first side of the first of the at least two moveable and rotatable door panels will face a first subject and a second side of the first of the at least two moveable and rotatable door panels will face a subsequent subject.

20. The portal apparatus of claim 19 further comprising programming for operation supporting bi-directional passage by successive subjects, the programming causing the portal apparatus to behave according to at least the steps of:

starting a bi-directional sequence of passage with the first of the at least two door panels oriented in a neutral position substantially longitudinally centered in the portal apparatus and also positioned substantially perpendicular to the at least one linear sidewall; and when approached by a first subject moving in the first longitudinal direction, rotating the first of the at least two moveable and rotatable door panel door panels to the position parallel to the at least one linear sidewall to allow the first subject to pass through the portal apparatus while rotating a second of the at least two moveable and rotatable door panels from the position parallel to the at least one linear sidewall to the neutral position; and with the second of the at least two moveable and rotatable door panels positioned in the neutral position, when a second and successive subject approaches the portal apparatus in the second longitudinal direction, rotating the second of the at least two moveable and rotatable door panel door panels to the position parallel to the at least one linear sidewall to allow the second subject to pass through the portal apparatus in the second longitudinal direction while rotating the first of the at least two moveable and rotatable door panels from the position parallel to the at least one linear sidewall to the neutral position.

* * * * *